US008935120B2

(12) United States Patent
Yoshioka et al.

(10) Patent No.: US 8,935,120 B2
(45) Date of Patent: Jan. 13, 2015

(54) REVOLUTION INCREASE-DECREASE DETERMINATION DEVICE AND REVOLUTION INCREASE-DECREASE DETERMINATION METHOD

(75) Inventors: Mototaka Yoshioka, Osaka (JP); Shinichi Yoshizawa, Osaka (JP)

(73) Assignee: Panasonic Corporation, Osaka (JP)

( * ) Notice: Subject to any disclaimer, the term of this patent is extended or adjusted under 35 U.S.C. 154(b) by 815 days.

(21) Appl. No.: 13/164,103

(22) Filed: Jun. 20, 2011

(65) Prior Publication Data

US 2011/0246126 A1 Oct. 6, 2011

Related U.S. Application Data

(63) Continuation of application No. PCT/JP2011/000035, filed on Jan. 7, 2011.

(30) Foreign Application Priority Data

Feb. 8, 2010 (JP) ..... 2010-025713

(51) Int. Cl.
*F02D 41/00* (2006.01)
*F02D 41/04* (2006.01)
*F02D 41/28* (2006.01)

(52) U.S. Cl.
CPC ..... *F02D 41/045* (2013.01); *F02D 41/0097* (2013.01); *F02D 2041/288* (2013.01); *F02D 2200/025* (2013.01)
USPC ..... 702/141

(58) Field of Classification Search
CPC ..... F02D 41/0097
USPC ..... 702/141
See application file for complete search history.

(56) References Cited

U.S. PATENT DOCUMENTS

| | | | | |
|---|---|---|---|---|
| 7,866,213 | B2 * | 1/2011 | Twerdochlib | 73/659 |
| 2010/0030562 | A1 * | 2/2010 | Yoshizawa et al. | 704/270 |
| 2010/0152991 | A1 | 6/2010 | Suzuki | |

FOREIGN PATENT DOCUMENTS

| | | |
|---|---|---|
| CN | 101331305 A | 12/2008 |
| JP | 06-102150 | 4/1994 |
| JP | 2000-099853 | 4/2000 |
| JP | 2006-207507 | 8/2006 |

OTHER PUBLICATIONS

Chinese Office Action and Search Report issued Aug. 5, 2014, in corresponding Chinese Application No. 201180001673.3 (with English translation of Search Report).

* cited by examiner

*Primary Examiner* — Bryan Bui
(74) *Attorney, Agent, or Firm* — Wenderoth, Lind & Ponack, L.L.P.

(57) ABSTRACT

An acceleration-deceleration determination device includes: a DFT analysis unit which calculate, from an engine sound, a frequency signal at a predetermined frequency for each of predetermined time periods; and an acceleration-deceleration determination unit which determines whether the number of engine revolutions is increasing or decreasing, by determining whether a phase of the frequency signal is increasing at an accelerating rate over time or decreasing at an accelerating rate over time.

13 Claims, 28 Drawing Sheets

REVOLUTION INCREASE-DECREASE DETERMINATION DEVICE AND REVOLUTION INCREASE-DECREASE DETERMINATION METHOD

CROSS REFERENCE TO RELATED APPLICATION

This is a continuation application of PCT application No. PCT/JP2011/000035 filed on Jan. 7, 2011, designating the United States of America.

BACKGROUND OF THE INVENTION (1) Field of the Invention

The present invention relates to a revolution increase-decrease determination device which determines whether the number of engine revolutions of a nearby vehicle is increasing or decreasing, on the basis of an engine sound emitted from the nearby vehicle.

(2) Description of the Related Art

Conventional technologies for determining conditions of a nearby vehicle include the following example.

Japanese Unexamined Patent Application Publication No. 2000-99853 discloses a technology whereby: an ambient sound is converted into a sound pressure level signal; an absolute level of the sound pressure level signal in a specific frequency band is compared with a reference level to determine the presence or absence of a nearby vehicle; and, based on temporal fluctuations in the sound pressure level signal, it is also determined whether the nearby vehicle is approaching or not. This technology is referred to as the first conventional technology hereafter.

SUMMARY OF THE INVENTION

With the first conventional technology: an ambient sound is converted into a sound pressure level signal; an absolute level of the sound pressure level signal in a specific frequency band is compared with a reference level to determine the presence or absence of a nearby vehicle; and, based on temporal fluctuations in the sound pressure level signal, it is also determined whether the nearby vehicle is approaching or not. That is to say, the first conventional technology is incapable of determining more detailed conditions of the nearby car, such as whether the number of engine revolutions of the nearby vehicle is increasing or decreasing or whether the nearby vehicle is accelerating or decelerating.

In general, in order to determine whether the number of engine revolutions of a nearby vehicle is increasing or decreasing or determine whether or not the nearby vehicle is approaching or is accelerating, a sound signal is required which is sufficiently long (for example, a few seconds) for observing fluctuations in the frequency of the engine sound and fluctuations in the sound pressure. On this account, it is difficult to use the conventional technology in applications, such as safe-driving support by which a driver needs to be informed, within a short time, about the increase or decrease in the number of engine revolutions of the nearby vehicle or about the acceleration or deceleration of the nearby vehicle.

The present invention is conceived in view of the stated problem, and has an object to provide a revolution increase-decrease determination device and so forth capable of determining, in real time, whether the number of engine revolutions of a nearby vehicle is increasing or decreasing.

In order to achieve the aforementioned object, the revolution increase-decrease determination device according to an aspect of the present invention is a revolution increase-decrease determination device including: a frequency analysis unit which calculates, from an engine sound, a frequency signal at a predetermined frequency for each of predetermined time periods; and a revolution determination unit which determines whether the number of engine revolutions is increasing or decreasing, by determining whether a phase of the frequency signal is increasing at an accelerating rate over time or decreasing at an accelerating rate over time.

To be more specific, the revolution determination unit determines that the number of engine revolutions is increasing when the phase is increasing at the accelerating rate over time, and determines that the number of engine revolutions is decreasing when the phase is decreasing at the accelerating rate over time.

When the number of engine revolutions increases, the frequency of the engine sound increases over time and the phase of the frequency signal of the engine sound increases at an accelerating rate. On the other hand, when the number of engine revolutions decreases, the frequency of the engine sound decreases over time and the phase of the frequency signal of the engine sound decreases at an accelerating rate. Whether the phase increases at an accelerating rate or decreases at an accelerating rate can be determined from phases included in a short time range. Accordingly, with this configuration, the increase or decrease in the number of engine revolutions of the nearby vehicle can be determined in real time.

Preferably, the revolution increase-decrease determination device further includes a phase curve calculation unit which calculates a phase curve approximating temporal fluctuations in the phase of the frequency signal, wherein the revolution determination unit determines whether the number of engine revolutions is increasing or decreasing by determining, on the basis of a form of the phase curve, whether the phase of the frequency signal is increasing at the accelerating rate or decreasing at the accelerating rate.

To be more specific, the revolution determination unit determines that the number of engine revolutions is increasing, by determining that the phase of the frequency signal is increasing at the accelerating rate when the phase curve is convex downward.

Also, the revolution determination unit determines that the number of engine revolutions is decreasing, by determining that the phase of the frequency signal is decreasing at the accelerating rate when the phase curve is convex upward.

When the phase increases at an accelerating rate, the phase curve is convex downward. When the phase decreases at an accelerating rate, the phase curve is convex upward. On the basis of these characteristics, whether the phase increases at an accelerating rate or decreases at an accelerating rate can be determined with accuracy. As a result, whether the number of engine revolutions increases or decreases can be determined.

Preferably, the revolution determination unit determines whether the number of engine revolutions is increasing or decreasing, only when a value representing a temporal fluctuation in the phase of the frequency signal is equal to or smaller than a predetermined threshold.

In a case where the nearby vehicle shifts gears, for example, the phase suddenly fluctuates. However, by excluding such a case, the aforementioned determination can be accordingly performed.

Preferably, the revolution increase-decrease determination device further includes a phase modification unit which modifies a phase that is different from a predetermined number of phases, by adding $\pm 2\pi * m$ (radian), where m is a natural number, to the phase so as to reduce a difference between the phase and the predetermined number of phases.

With this, the phase which is significantly shifted with respect to the phases at other times can be modified, so that the increase or decrease in the number of engine revolutions can be determined with accuracy.

Moreover, the revolution increase-decrease determination device may further include: an error calculation unit which calculates an error between the phase curve and the phase of the frequency signal; and a phase modification unit which modifies the phase of the frequency signal by adding $\pm 2\pi * m$ (radian), where m is a natural number, to the phase so as to include the phase within an angular range, the modification being performed for each of different angular ranges, wherein the phase curve calculation unit calculates the phase curve for each of the angular ranges, the error calculation unit calculates the error for each of the angular ranges, the phase modification unit further selects one of the angular ranges in which the error between the phase curve and the phase of the frequency signal is a minimum, and the revolution determination unit determines whether the number of engine revolutions is increasing or decreasing by determining, on the basis of a form of the phase curve in the selected angular range, whether the phase of the frequency signal is increasing at the accelerating rate or decreasing at the accelerating rate.

With this, the phase which is significantly shifted with respect to the phases at other times can be modified, so that the increase or decrease in the number of engine revolutions can be determined with accuracy.

Preferably, the frequency analysis unit calculates, from a mixed sound including a noise and an engine sound, a frequency signal at the predetermined frequency for each of the predetermined time periods, the phase curve calculation unit calculates a phase curve approximating temporal fluctuations in a phase of the frequency signal of the mixed sound, the revolution increase-decrease determination device further includes: an error calculation unit which calculates an error between the phase curve and the phase of the frequency signal of the mixed sound; and a sound signal identification unit which identifies, on the basis of the error, whether or not the mixed sound is the engine sound, and the revolution determination unit determines whether the number of engine revolutions is increasing or decreasing, on the basis of the phase of the mixed sound which is determined as being the engine sound by the sound signal identification unit.

With this configuration, the influence of noise can be eliminated. Hence, whether the number of engine revolutions is increasing or decreasing can be determined only based on the engine sound. This can accordingly improve the accuracy of the determination.

More preferably, the frequency analysis unit calculates a frequency signal for each of a plurality of engine sounds received, respectively, by a plurality of microphones arranged at a distance from each other, and the revolution increase-decrease determination device further includes a direction detection unit which detects a sound source direction of the engine sound on the basis of an arrival time difference between the engine sounds received by the microphones, and outputs a result of detecting the sound source direction only when the revolution determination unit determines that the number of engine revolutions is increasing.

Only when the number of engine revolutions is determined as being increasing, the result of detecting the direction of the sound source can be provided. Therefore, only in an especially dangerous case such as when an accelerating vehicle is approaching, the driver can be informed of the direction from which this accelerating vehicle is approaching.

It should be noted that the present invention can be implemented not only as a revolution increase-decrease determination device including the characteristic units as described above, but also as a revolution increase-decrease determination method having, as steps, the characteristic processing units included in the revolution increase-decrease determination device. Also, the present invention can be implemented as a computer program causing a computer to execute the characteristic steps including in the revolution increase-decrease determination method. It should be obvious that such a computer program can be distributed via a nonvolatile recording medium such as a Compact Disc-Read Only Memory (CD-ROM) or via a communication network such as the Internet.

The present invention is capable of determining, in real time, whether the number of engine revolutions of a nearby vehicle is increasing or decreasing.

FURTHER INFORMATION ABOUT TECHNICAL BACKGROUND TO THIS APPLICATION

The disclosure of Japanese Patent Application No. 2010-025713 filed on Feb. 8, 2010 including specification, drawings and claims is incorporated herein by reference in its entirety.

The disclosure of PCT application No. PCT/JP2011/000035 filed on Jan. 7, 2011, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DETAILED DESCRIPTION OF THE INVENTION

Characteristics in the present invention include determining whether a vehicle is accelerating or decelerating on the basis of temporal fluctuations in the phase of a sound which is a periodic sound such as an engine sound and whose frequency fluctuates over time. It should be noted that the periodic sound in the present invention refers to a sound whose phase is constant or whose phase fluctuations are cyclic.

Figure 1:
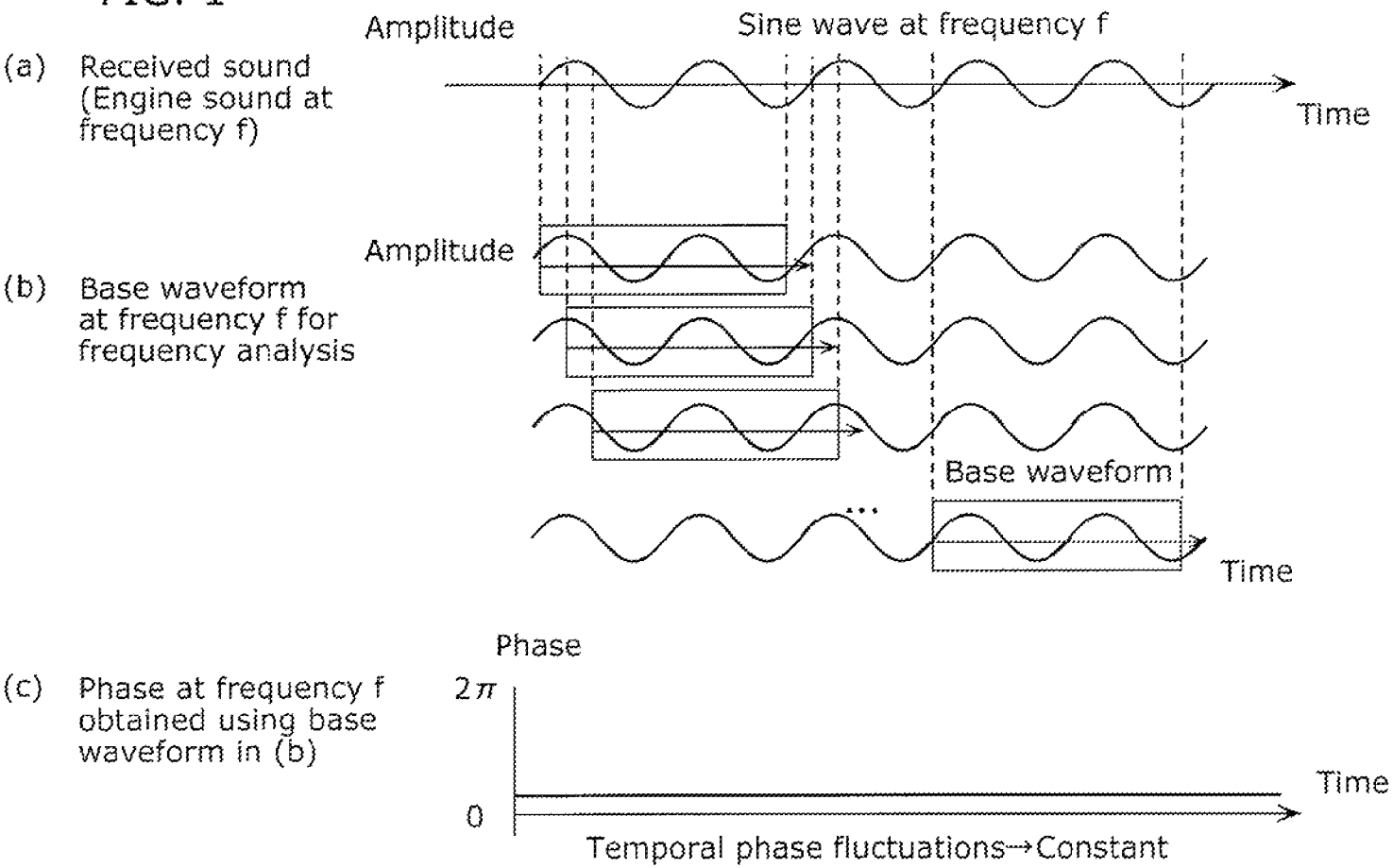
FIG. 1 is a diagram explaining a phase according to the present invention.

Here, the term "phase" used in the present invention is defined with reference to FIG. 1. In (a) of FIG. 1, an example of a received engine sound is schematically shown. The horizontal axis represents time whereas the vertical axis represents amplitude. This diagram shows a case, as an example, where the number of engine revolutions is constant with respect to the time and the frequency of the engine sound does not fluctuate.

Moreover, (b) of FIG. 1 shows a sine wave at a predetermined frequency f which is a base waveform used when a frequency analysis is performed via a Fourier transform (in this example, a value which is the same as the frequency of the engine sound is used as the predetermined frequency f). The horizontal axis and the vertical axis are the same as those in (a) of FIG. 1. A frequency signal (phase) is obtained by the convolution process performed on this base waveform and the received engine sound. In the present example, by performing the convolution process on the received engine sound while the base waveform is fixed without being shifted in the direction of the time axis, the frequency signal (phase) is obtained for each of the times.

The result obtained by this process is shown in (c) of FIG. 1. The horizontal axis represents time and the vertical axis represents phase. In this example, the number of engine revolutions is constant with respect to the time, and the frequency of the received engine sound is constant with respect to the time. In other words, the phase at the predetermined frequency f does not increase at an accelerating rate nor decrease at an accelerating rate. In the present example, the value which is the same as the frequency of the engine sound whose number of revolutions is constant is used as the predetermined frequency f. In the case where a value smaller than the frequency of the engine sound is used as the predetermined frequency f, the phase increases like a linear function. In the case where a value greater than the frequency of the engine sound is used as the predetermined frequency f, the phase decreases like a linear function. In either of these cases, the phase at the predetermined frequency f does not increase at an accelerating rate nor decrease at an accelerating rate.

It should be noted that, in the sound signal processing, the Fast Fourier Transform (FFT), and the like, it is common to perform the convolution process while the base waveform is being shifted in the direction of the time axis. In the case where the convolution process is performed while the base waveform is being shifted in the direction of the time axis, the phase can be modified later to be converted into a phase defined in the present invention. The explanation is given as follows, with reference to the drawings.

Figure 2:
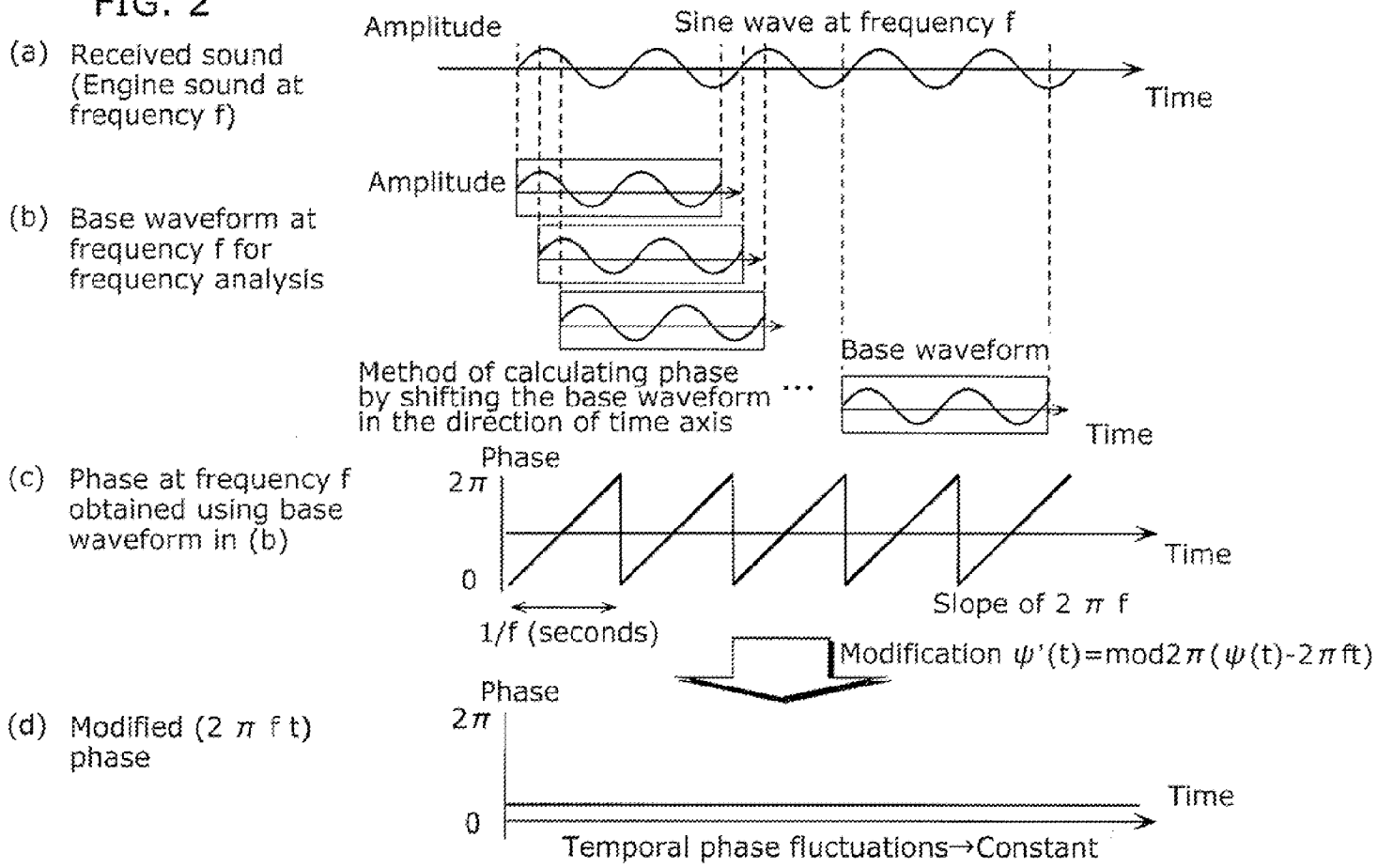
FIG. 2 is a diagram explaining a phase according to the present invention.

FIG. 2 is a diagram explaining a phase. In (a) of FIG. 2, an example of a received engine sound is schematically shown. The horizontal axis represents time whereas the vertical axis represents amplitude.

Moreover, (d) of FIG. 2 shows a sine wave at a predetermined frequency f which is a base waveform used when a frequency analysis is performed via a Fourier transform (in this example, a value which is the same as the frequency of the engine sound is used as the predetermined frequency f). The horizontal axis and the vertical axis are the same as those in (a) of FIG. 2. A frequency signal (phase) is obtained by the convolution process performed on this base waveform and the received engine sound. In the present example, by performing the convolution process on the received engine sound while the base waveform is being shifted in the direction of the time axis, the frequency signal (phase) is obtained for each of the times.

The result obtained by this process is shown in (c) of FIG. 2. The horizontal axis represents time and the vertical axis represents phase. In this example, since the received engine sound is at the frequency f, the pattern of the phase at the frequency f is cyclically repeated in a cycle of 1/f. When the phase cyclically repeated in the calculated phase $\psi(t)$ is modified (that is, modified to a phase $\psi(t)=\mathrm{mod}\ 2\pi(\psi(t)-2\pi ft)$ (where f is the analysis-target frequency)), a phase shown in (d) of FIG. 2 is obtained. More specifically, the phase modification process can convert the phase into the phase defined in the present invention as shown in (c) of FIG. 1.

Next, an explanation is given about temporal fluctuations in the frequency of the engine sound. The frequency of the engine sound fluctuates as the number of engine revolutions fluctuates over time.

Figure 3:
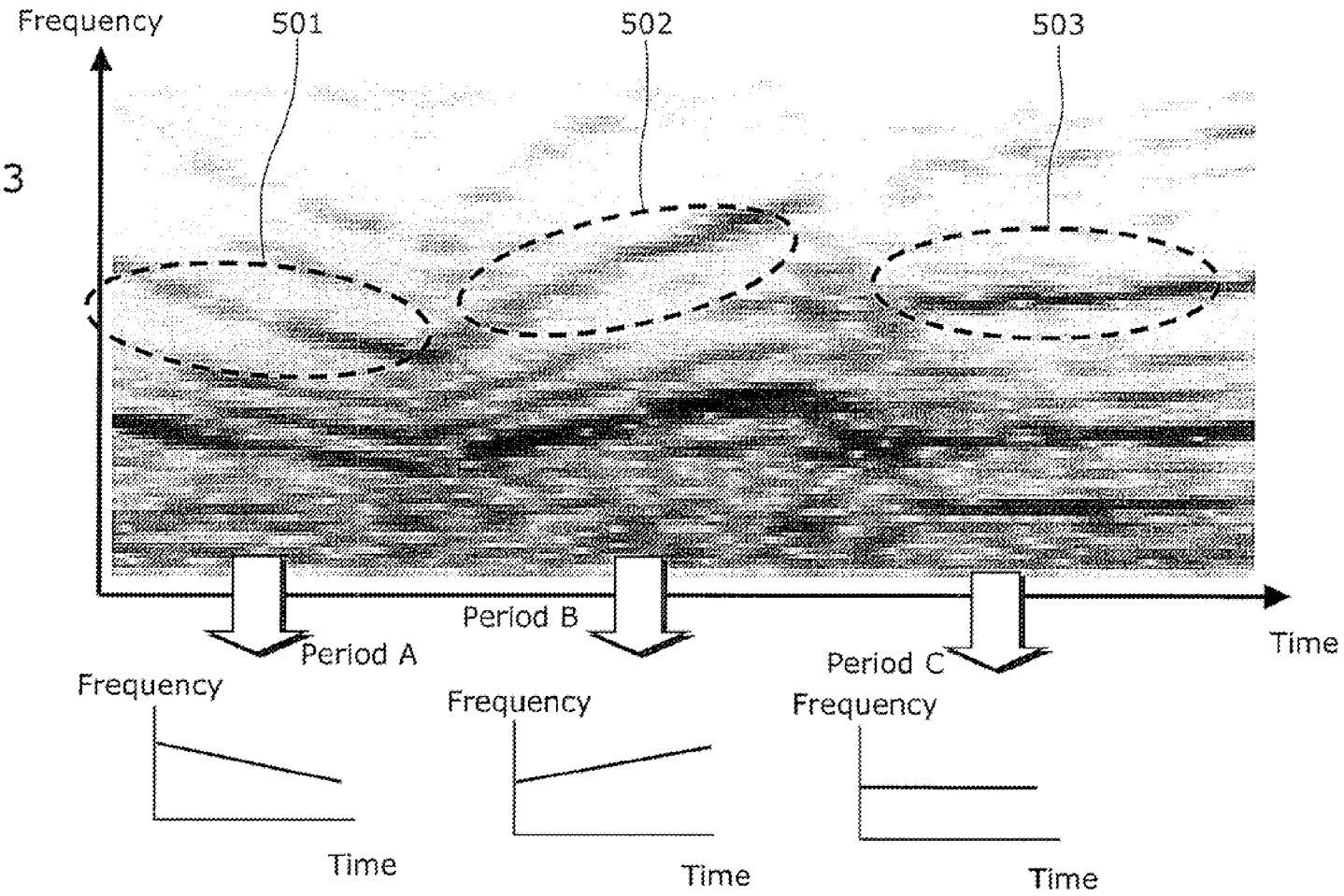
FIG. 3 is a diagram explaining an engine sound.

FIG. 3 is a diagram showing a spectrogram obtained as a result of an analysis performed on the engine sound of a vehicle by a Discrete Fourier Transform (DFT) analysis unit which is described later. The horizontal axis represents time whereas the vertical axis represents frequency. The color density of the spectrogram represents the magnitude of power of a frequency signal. When the color is darker (i.e., closer to black), the power of the frequency signal is greater. FIG. 3 shows data in which noise such as wind noise has been eliminated as much as possible and, therefore, the darker parts (i.e., the blackish parts) basically indicate the engine sound. Generally speaking, the engine sound can be represented by the data of the revolutions fluctuating over time, as shown in FIG. 3. From the spectrogram, it can be seen that the frequency fluctuates over time.

In an engine, a predetermined number of cylinders make piston motion to cause revolutions to a powertrain. The engine sound from the vehicle includes: a sound dependent on the engine revolutions; and a fixed vibration sound and an aperiodic sound which are independent of the engine revolutions. In particular, the sound mainly detected from the outside of the vehicle is the periodic sound dependent on the engine revolutions. In the following embodiments, acceleration-deceleration determination is performed on the basis of this periodic sound dependent on the engine revolutions.

It can be seen from dashed-line circles 501, 502, and 503 in FIG. 3 that, as the number of engine revolutions fluctuates, the frequency of the engine sound fluctuates, period by period, with respect to the time.

Here, attention is focused on the fluctuations in the frequency. As can be seen, the frequency seldom randomly fluctuates and is seldom discretely scattered. The frequency shows a certain fluctuation behavior during a certain time period. For example, the frequency decreases, that is, falls to the right in a period A. During the period A, the number of engine revolutions is decreasing, meaning that the vehicle is decelerating. The frequency increases, that is, rises to the right in a period B. During the period B, the number of engine revolutions is increasing, meaning that the vehicle is accelerating. The frequency remains approximately constant in a period C. During the period C, the number of engine revolutions remains constant, meaning that the vehicle is running at a constant speed.

A relation between the fluctuations in the number of engine revolutions and the phase of the engine sound is analyzed as follows.

Figure 4:
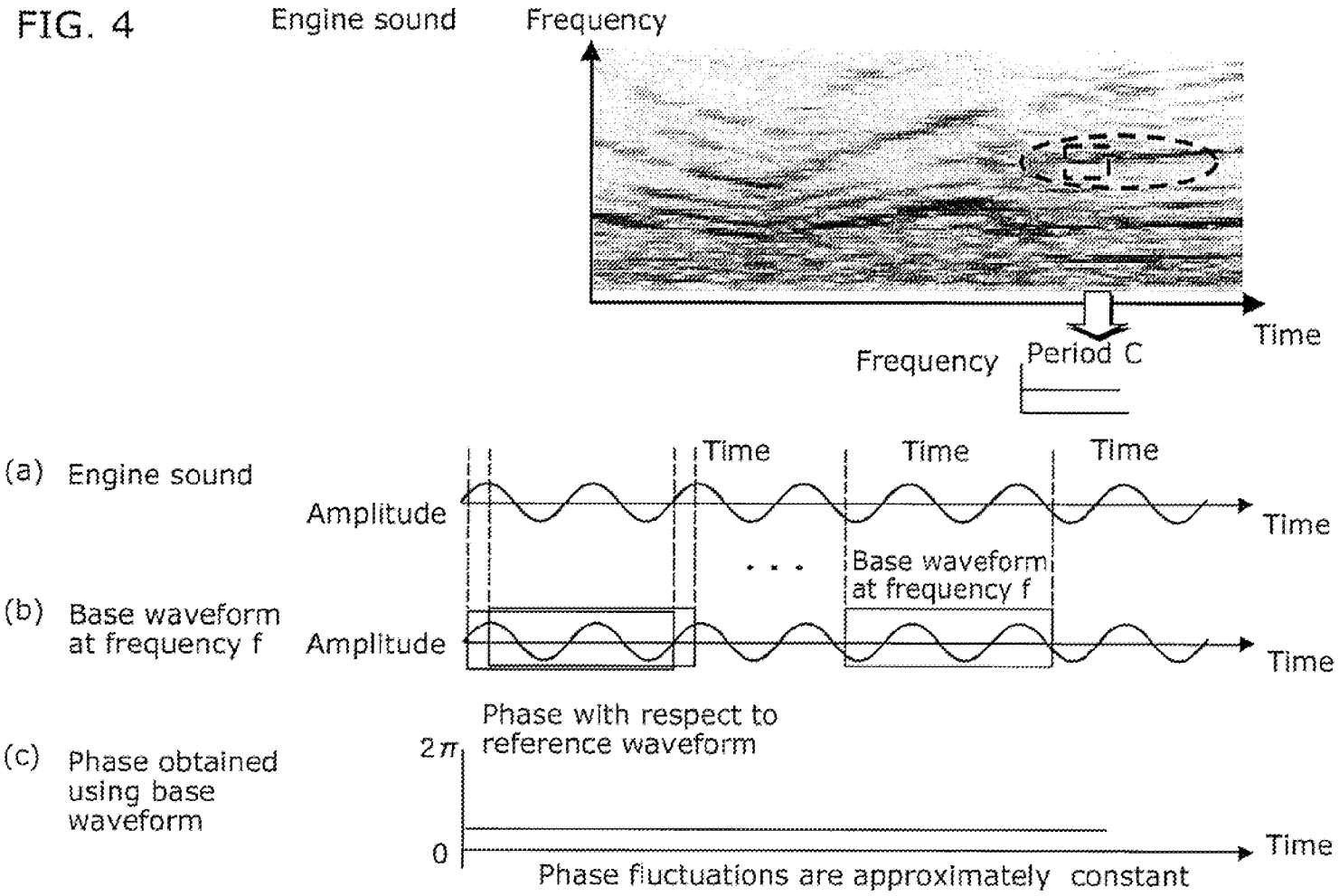
FIG. 4 is a diagram explaining a phase of an engine sound in the case where the number of engine revolutions is constant.

In FIG. 4, (a) schematically shows the engine sound in the period C where the number of engine revolutions is constant. Note that the frequency of the engine sound is represented by "f". In FIG. 4, (b) shows a base waveform. In this diagram, the frequency of the base waveform is represented by the same value as the frequency f of the engine sound. In FIG. 4, (c) shows a phase with respect to the base waveform. As shown in (c) of FIG. 4, when the number of revolutions is constant, the engine sound shows a certain periodicity as is the case with the sine wave shown in FIG. 1. Thus, the phase at the predetermined frequency f does not increase at an accelerating rate over time nor decrease at an accelerating rate over time.

It should be noted that, when the frequency of a target sound is constant and the frequency of a base waveform is low, the phase gradually delays. However, since the amount of decrease is constant, the phase linearly decreases. On the other hand, when the frequency of the target sound is constant and the frequency of the base waveform is high, the phase gradually advances. However, since the amount of increase is constant, the phase linearly increases.

Figure 5:
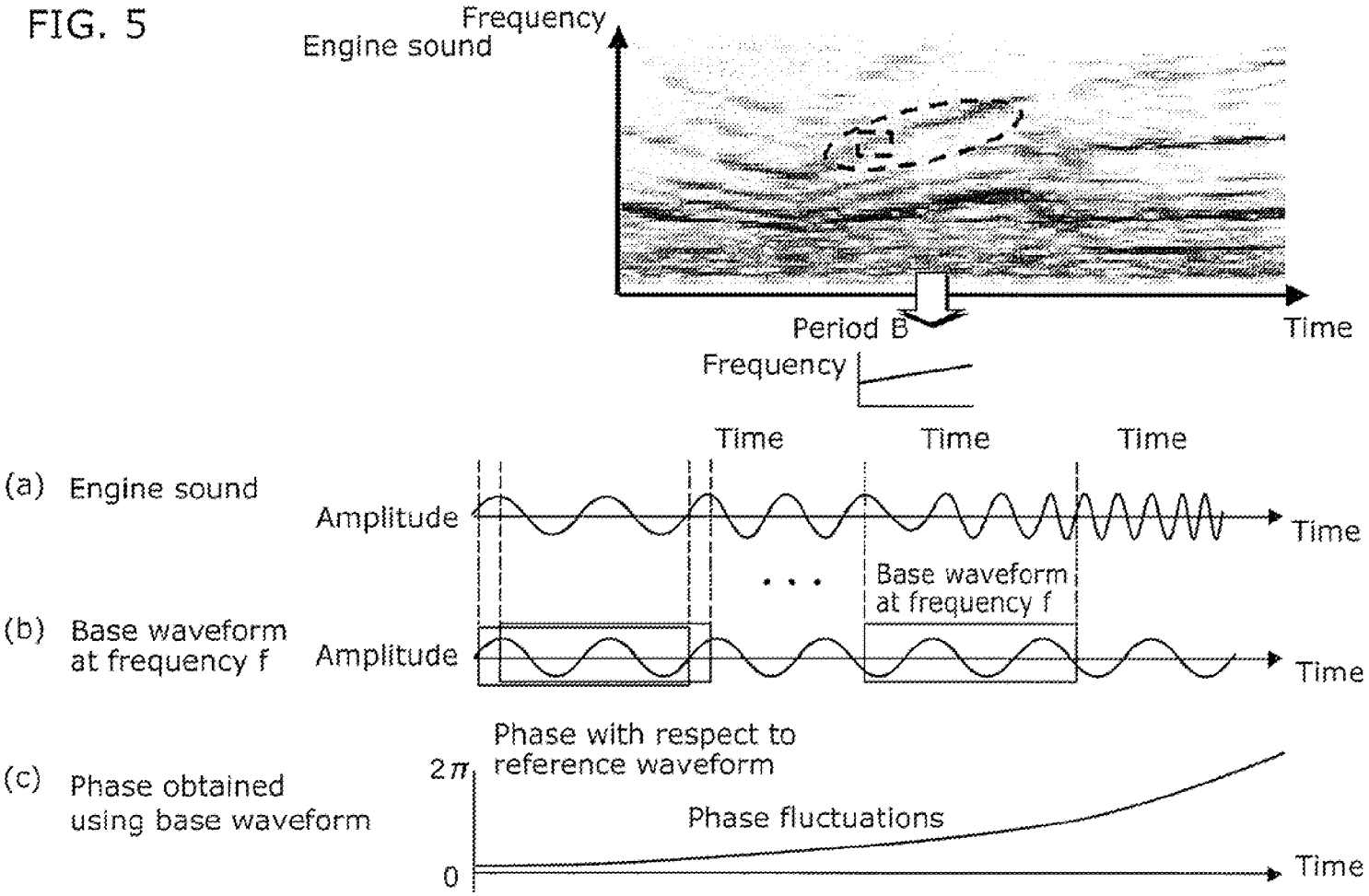
FIG. 5 is a diagram explaining a phase of an engine sound in the case where the number of engine revolutions increases and a vehicle thus accelerates.

In FIG. 5, (a) schematically shows the engine sound in the period B where the number of engine revolutions increases and the vehicle thus accelerates. During the period B, the frequency of the engine sound increases over time. In FIG. 5, (b) shows a base waveform. Note that the frequency of the engine sound is represented by "f", for example. In FIG. 5, (c) shows a phase with respect to the base waveform. The engine sound has a periodicity like a sine wave, and the frequency gradually increases. Thus, as shown in (c) of FIG. 5, the phase with respect to the base waveform increases at an accelerating rate over time.

Figure 6:
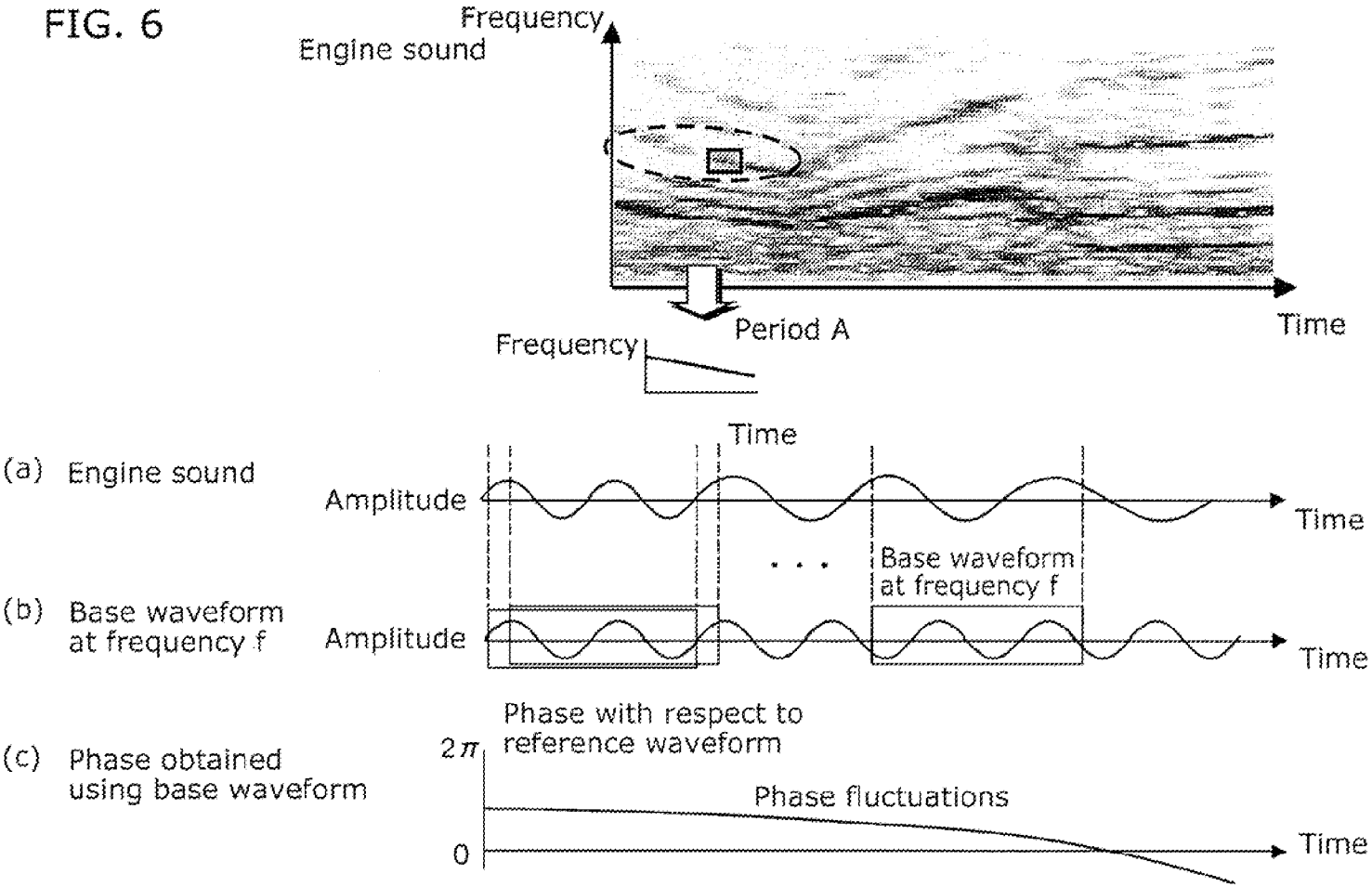
FIG. 6 is a diagram explaining a phase of an engine sound in the case where the number of engine revolutions decreases and a vehicle thus decelerates.

In FIG. 6, (a) schematically shows the engine sound in the period A where the number of engine revolutions decreases and the vehicle thus decelerates. During the period B, the frequency of the engine sound decreases over time. In FIG. 6, (b) shows a base to waveform. Note that the frequency of the engine sound is represented by "f", for example. In FIG. 6, (c) shows a phase with respect to the base waveform. The engine sound has a periodicity like a sine wave, and the frequency gradually decreases. Thus, as shown in (c) of FIG. 6, the phase with respect to the base waveform decreases at an accelerating rate over time.

Thus, as shown in (c) of FIG. 5 or (c) of FIG. 6, an increase or decrease in the number of engine revolutions, that is, acceleration or deceleration of the vehicle can be determined by calculating, using the phase with respect to the base waveform, a phase increase or decrease having an accelerating rate over time. Also, as compared to the conventional technology whereby the acceleration-deceleration determination is made on the basis of fluctuations in spectral power, the acceleration-deceleration determination in the following embodiments can be made more instantaneously on the basis of data of a short time by taking advantage of the characteristics that the phase significantly fluctuates in the short time. Therefore, the driver can be informed, within a short time, about acceleration or deceleration of a nearby vehicle. For example, suppose that the vehicle of the driver is running on a priority road and that a stop line is present on a road where a nearby vehicle is running. In this case, at a blind intersection, the driver of the vehicle on the priority road can be informed whether the nearby vehicle is going to drive through the intersection at an increasing speed or a constant speed or is going to stop at the stop line.

The following is a description of the embodiments according to the present invention, with reference to the drawings.

First Embodiment

An acceleration-deceleration determination device in the first embodiment is described as follows. This acceleration-deceleration determination device corresponds to a revolution increase-decrease determination device in the claims set forth below.

Figure 7:
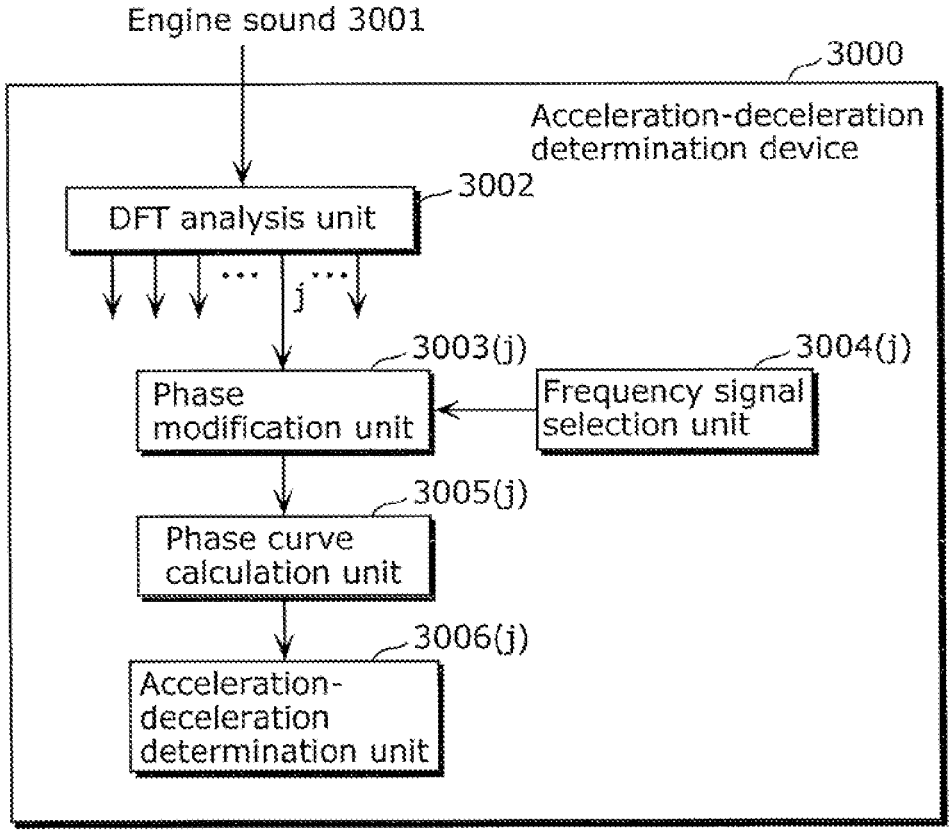
FIG. 7 is a block diagram showing an entire configuration of an acceleration-deceleration determination device in a first embodiment according to the present invention.

FIG. 7 is a block diagram showing a configuration of an acceleration-deceleration determination device in the first embodiment according to the present invention.

In FIG. 7, an acceleration-deceleration determination device 3000 includes a DFT analysis unit 3002, a phase modification unit 3003 (*j*) (j=1 to M), a frequency signal selection unit 3004 (*j*) (j=1 to M), a phase curve calculation unit 3005 (*j*) (j=1 to M), and an acceleration-deceleration determination unit 3006 (*j*) (j=1 to M). The phase modification unit 3003 (*j*) (j=1 to M) includes an M number of phase modification units, and a j-th phase modification unit 3003 (*j*) executes processing for a j-th frequency band as described later. In the present specification, the same processing is performed for the other frequency bands by the corresponding units having reference numbers assigned as above.

The DFT analysis unit 3002 corresponds to a frequency analysis unit in the claims set forth below. The acceleration-deceleration determination unit 3006 (*j*) corresponds to a revolution determination unit in the claims set forth below.

The DFT analysis unit 3002 performs the Fourier transform processing on a received engine sound 3001 to obtain, for each of a plurality of frequency bands, a frequency signal including phase information on the engine sound 3001. It should be noted that the DFT analysis unit 3002 may perform the frequency conversion according to a different method of processing, such as the fast Fourier transform processing, the discrete cosine transform processing, or the wavelet transform processing.

Hereinafter, the number of frequency bands obtained by the DFT analysis unit 3002 is represented as M and a number identifying a frequency band is represented as a symbol j (j=1 to M).

Supposing that a phase of the frequency signal at a time t is represented as $\psi(t)$ (radian), the phase modification unit 3003 (*j*) (j=1 to M) makes a phase modification to the frequency signal of the frequency band j obtained by the DFT analysis unit 3002. To be more specific, the phase $\psi(t)$ of the frequency signal at the time t is modified to $\psi'(t)=\mathrm{mod}\ 2\pi(\psi(t)-2\pi ft)$ (where f is the analysis-target frequency).

The frequency signal selection unit 3004 (*j*) (j=1 to M) selects frequency signals which are to be used for calculating a phase curve, from among the frequency signals, in a predetermined period, to which the phase modification unit 3003 (*j*) (j=1 to M) has made phase modifications.

The phase curve calculation unit 3005 (*j*) (j=1 to M) calculates, as a quadratic curve, a phase form which fluctuates over time, using the modified phase $\psi(t)$ of the frequency signals selected by the frequency signal selection unit 3004 (*j*) (j=1 to M).

On the basis of the amount of increase in the phase detected from the phase curve calculated by the phase curve calculation unit 3005 (*j*) (j=1 to M), the acceleration-deceleration determination unit 3006 (*j*) (j=1 to M) determines whether the number of engine revolutions is increasing or decreasing, that is, whether the vehicle is accelerating or decelerating. When the number of engine revolutions is increasing over time, this indicates that the vehicle is accelerating. When the number of engine revolutions is decreasing, this indicates that the vehicle is decelerating.

These processes are performed while the predetermined period is being shifted in the direction of the time axis.

It should be noted that the DFT analysis unit 3002 and the acceleration-deceleration determination unit 3006 (*j*) shown in FIG. 7 are essential components in the present invention. In the case where the DFT analysis unit 3002 is capable of directly deriving the phase defined in the present invention as shown in (c) of FIG. 1, the phase modification unit 3003 (*j*) is unnecessary.

Next, an operation performed by the acceleration-deceleration determination device 3000 configured as described thus far is explained.

In the following, the j-th frequency band is described. The description is presented on the assumption, as an example, that a center frequency of the frequency band agrees with the frequency of a base waveform. To be more specific, it is determined whether or not the frequency f in the phase $\psi'(t)$ ($=\mathrm{mod}\ 2\pi(\psi(t)-2\pi ft)$) increases with respect to the analysis-target frequency f. It should be noted that, in the present embodiment, the DFT analysis unit 3002 performs a common frequency analysis which is executed while the base waveform is being shifted in the direction of the time axis, and that the resultant phase is $\psi(t)$. Then, the processing to modify the phase $\psi(t)$ to the phase $\psi'$ defined above (i.e., $\psi'(t)(=\mathrm{mod}\ 2\pi(\psi(t)-2\pi ft))$) is performed.

Figure 8:
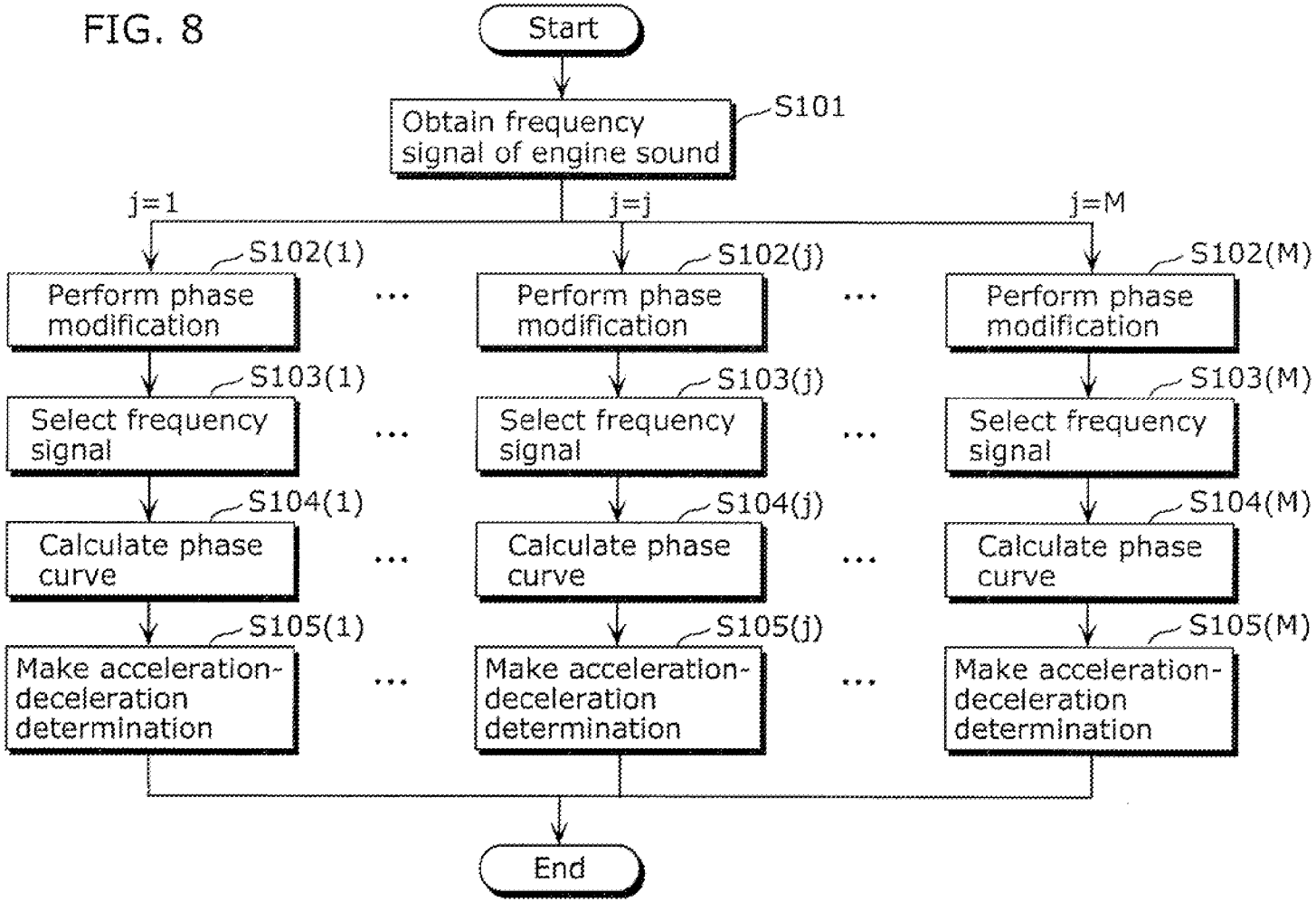
FIG. 8 is a flowchart showing an operational procedure executed by the acceleration-deceleration determination device in the first embodiment according to the present invention.

FIG. 8 is a flowchart showing an operational procedure executed by the acceleration-deceleration determination device 3000.

Firstly, the DFT analysis unit 3002 receives the engine sound 3001 and then performs the Fourier transform processing on the engine sound 3001 to obtain a frequency signal for each frequency band j (step S101).

Next, supposing that the phase of the frequency signal at the time t is represented as $\psi(t)$ (radian), the phase modification unit 3003 (*j*) (j=1 to M) makes a phase modification to the frequency signal of the frequency band j obtained by the DFT analysis unit 3002 to convert the phase $\psi(t)$ into the phase $\psi'(t)=\mathrm{mod}\ 2\pi(\psi(t)-2-\pi ft)$ (where f is the analysis-target frequency) (step S102 (*j*)).

The following explains a reason why the phase is used in the present invention and also describes an example of a phase modification method, with reference to the drawings.

FIG. 3 is a spectrogram obtained as a result of the analysis performed on the engine sound of the vehicle by the DFT analysis unit 3002. The vertical axis represents frequency whereas the horizontal axis represents time. The color density of the spectrogram represents the magnitude of power of a frequency signal. When the color is darker, the power of the frequency signal is greater. FIG. 3 shows data in which noise such as wind noise has been eliminated as much as possible and, therefore, the darker parts basically indicate the engine sound. Generally speaking, the engine sound can be represented by the data of the revolutions fluctuating over time, as shown in FIG. 3. From the spectrogram, it can be seen that the frequency fluctuates over time.

In an engine, a predetermined number of cylinders make piston motion to cause revolutions to a powertrain. The engine sound from the vehicle includes: a sound dependent on the engine revolutions; and a fixed vibration sound or an aperiodic sound which is independent of the engine revolutions. In particular, the sound mainly detected from the outside of the vehicle is the periodic sound dependent on the engine revolutions. In the present embodiment, on the basis of that the periodic sound is dependent on the engine revolutions, the acceleration-deceleration determination is made according to the temporal fluctuations in the phase.

It can be seen from the dashed-line circles 501, 502, and 503 in FIG. 3 that, as the number of engine revolutions fluctuates, the frequency of the engine sound fluctuates over time. Here, attention is focused on the fluctuations in the frequency. As can be seen, the frequency seldom randomly fluctuates and is seldom discretely scattered. The frequency shows a certain fluctuation behavior during a certain time period. For example, the frequency decreases, that is, falls to the right in the period A. During the period A, the number of engine revolutions is decreasing, meaning that the vehicle is decelerating. The frequency increases, that is, rises to the right in the period B. During the period B, the number of engine revolutions is increasing, meaning that the vehicle is accelerating. The frequency remains approximately constant in the period C. During the period C, the number of engine revolutions remains constant, meaning that the vehicle is running at a constant speed.

Figure 9:
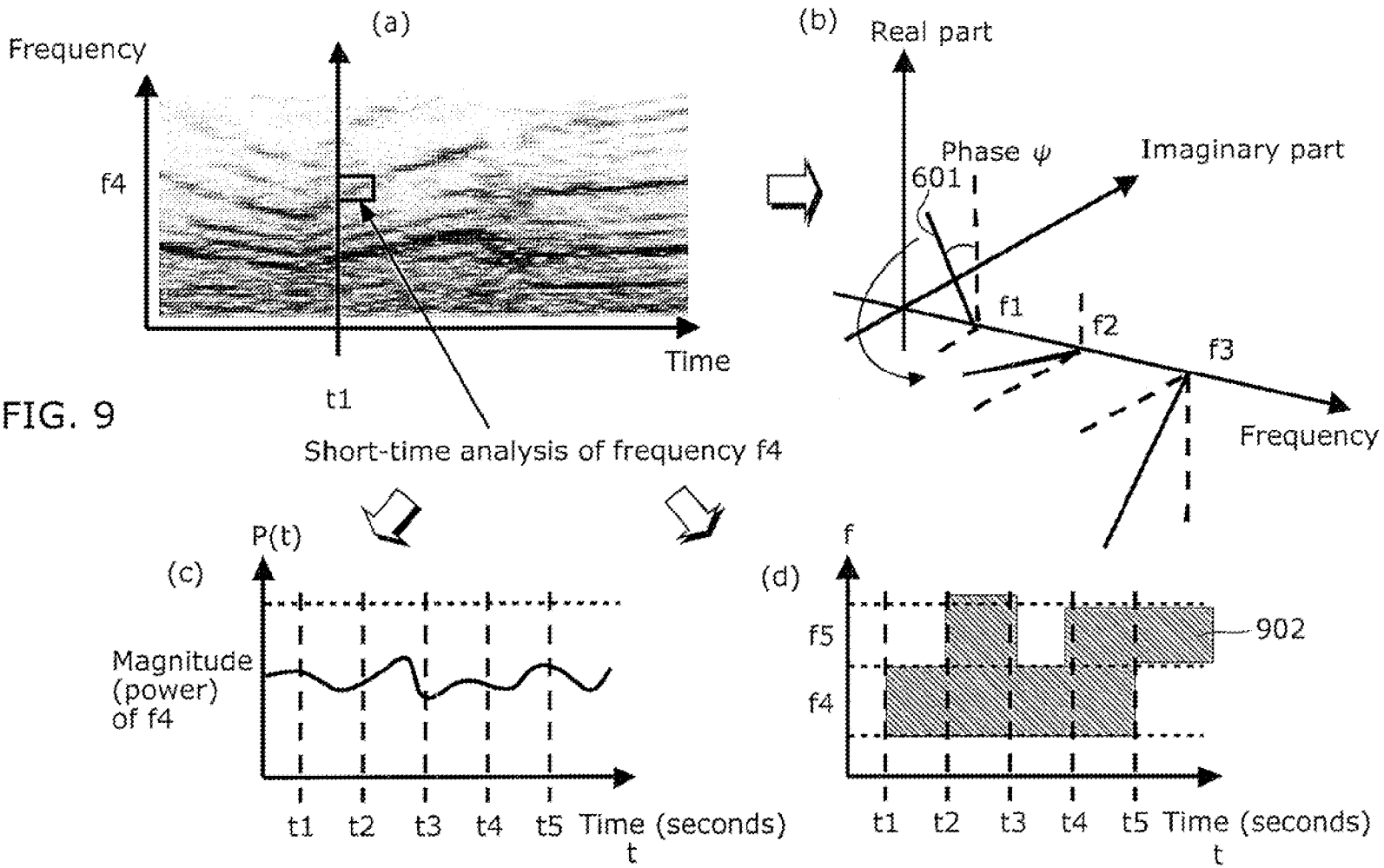
FIG. 9 is a diagram explaining about power and phase in a DFT analysis.

FIG. 9 is a diagram explaining about power and phase in the DFT analysis. In FIG. 9, (a) shows a spectrogram obtained as a result of the analysis performed on the engine sound of the vehicle, as in FIG. 3.

In FIG. 9, (b) is a diagram showing a concept of the DFT analysis. This diagram shows a frequency signal 601, as an example, in a complex space using a predetermined window function (the Hanning window) with a predetermined time window width measured from a time t1 as the time period where the number of engine revolutions is increasing and thus the vehicle is accelerating. An amplitude and a phase are calculated for each of the frequencies such as frequencies f1, f2, and f3. A length of the frequency signal 601 indicates the magnitude (power) of the amplitude, and an angle which the frequency signal 601 forms with the real axis indicates the phase. The frequency signal is obtained for each of the times while the time shift is being executed. In general, the spectrogram shows only the power of the frequency at each of the times and omits the phase. Thus, each of the spectrograms shown in FIG. 3 and (a) of FIG. 9 shows only the magnitude of power obtained as a result of the DFT analysis.

Suppose that a real part of the frequency signal is represented as x(t) and that an imaginary part of the frequency signal is represented as y(t). In this case, the phase ψ(t) and the magnitude (power) P(t) are expressed as follows.

$$\psi(t)=\text{mod } 2\pi(\arctan(y(t)/x(t))) \quad \text{(Equation 1)}$$

$$P(t)=\sqrt{x(t)^2+y(t)^2} \quad \text{(Equation 2)}$$

In the above equations, "t" represents a time corresponding to the frequency.

In FIG. 9, (c) shows temporal fluctuations in the power of the frequency (the frequency f4, for example) in the time period where the number of engine revolutions is increasing and thus the vehicle is accelerating as shown in (a) of FIG. 9. The horizontal axis represents time whereas the vertical axis represents the magnitude (power) of the frequency signal. As can be seen from (c) of FIG. 9, the power fluctuates randomly and, therefore, an increase or decrease cannot be observed. As shown in (c) of FIG. 9, a common spectrogram omits the phase information and shows signal fluctuations only based on the power. For this reason, a sound signal is required which is sufficiently long (for example, a few seconds) for observing fluctuations in the sound pressure of the engine sound. Moreover, when noise such as wind noise is included, the fluctuations in the sound pressure become lost in the noise, which makes the observation difficult. On this account, it has been difficult to use the conventional technology in applications such as safe-driving support by which a driver needs to be informed, within a short time, about the acceleration or deceleration of the nearby vehicle.

In FIG. 9, (d) shows temporal fluctuations between predetermined frequencies in a time period where the number of engine revolutions is increasing and thus the vehicle is accelerating as shown in (a) of FIG. 9. Note that, in this period, the number of revolutions increases from f4 to f5. The horizontal axis represents time whereas the vertical axis represents frequency. An area 902 which is diagonally shaded represents a period where the power is at a certain level. As can be seen from (d) of FIG. 9, the frequency fluctuates randomly and, therefore, an increase or decrease in the number of engine revolutions cannot be observed. As shown in (c) of FIG. 9, a common spectrogram omits the phase information and shows signal fluctuations only based on the power. For this reason, a sound signal is required which is sufficiently long (for example, a few seconds) for observing fluctuations in the frequency of the engine sound. Moreover, when noise such as wind noise is included, the fluctuations in the frequency become lost in the noise, which makes the observation difficult. For example, even when the frequency of the engine sound fluctuates from f4 to f5, this fluctuation cannot be observed from the frequency information in the case where the noise is present during this period. On this account, it has been difficult to use the conventional technology in applications such as safe-driving support by which a driver needs to be informed, within a short time, about the acceleration or deceleration of the nearby vehicle.

With this being the situation, the present embodiment focuses on the phase, and makes the acceleration-deceleration determination on the basis of the temporal fluctuations in the phase.

A relationship between fluctuations in the number of engine revolutions and the temporal fluctuations in the phase can be expressed as follows.

$$\psi(t)=2\pi\int f(t)dt \quad \text{(Equation 3)}$$

As shown in FIG. 3, for example, the frequency of the engine sound seldom randomly fluctuates and is seldom discretely scattered. The frequency shows a certain fluctuation behavior during a certain time period. Thus, the fluctuations are approximated by a piecewise linear function represented as follows.

$$f(t)=At+f_0 \quad \text{(Equation 4)}$$

To be more specific, the frequency f at the time t can be linearly approximated using a line segment which increases or decreases from an initial value $f_0$ in proportion to the time t (i.e., a proportionality coefficient A) in a predetermined time period.

When the frequency f is expressed by Equation 4 above, the phase ψ at the time t can be expressed as follows.

$$\psi(t)=2\pi\int f(t)dt=2\pi\int(At+f_0)dt=\pi At^2+2\pi f_0t+\psi_0 \quad \text{(Equation 5)}$$

In Equation 5, $\psi_0$ in the third term on the right-hand side indicates an initial phase, and the second term ($2\pi f_0t$) indicates that the phase advances by an angular frequency $2\pi f_0t$ in proportion to the time t. Also, the first term ($\pi At^2$) indicates that the phase can be approximated by a quadratic curve.

Next, the phase modification process to ease the approximation performed on the temporal phase fluctuations is explained.

In general, the phase obtained via the FFT and the DFT is calculated while the base waveform is being shifted in the direction of the time axis. On this account, as shown in (c) and (d) of FIG. 2, the phase modification needs to be made to convert the phase ψ(t) into the phase ψ'(t)=mod 2π(ψ(t)−2πft) (where f is the analysis-target frequency). The detailed explanation is presented as follows.

Figure 10:
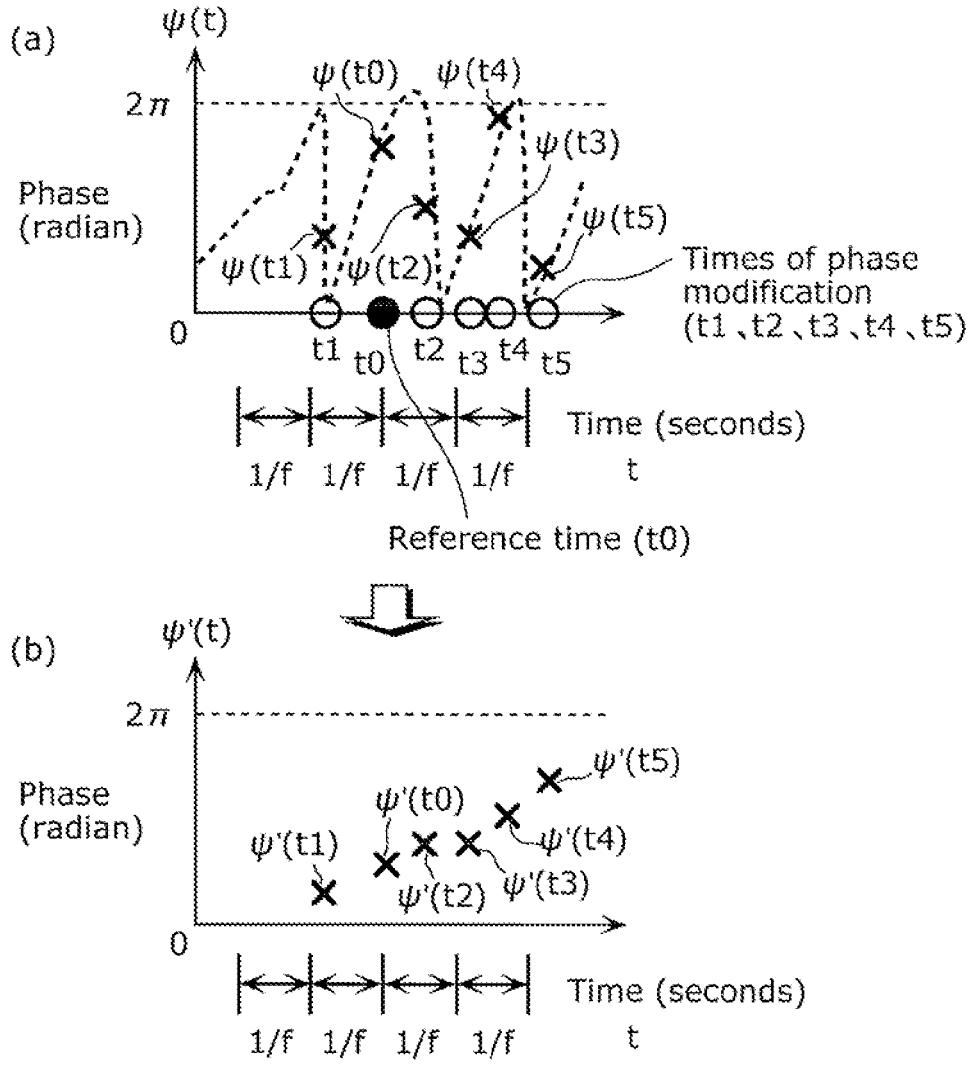
FIG. 10 is a diagram explaining a phase modification process.

Firstly, the phase modification unit 3003 (*j*) determines a reference time. In FIG. 10, (a) is a diagram showing the phase in a predetermined time period from the time t1 shown in (a) of FIG. 9. In (a) of FIG. 10, a time t0 indicated by a filled circle is determined as the reference time.

Next, the phase modification unit 3003 (*j*) determines a plurality of times of the frequency signals to which phase modifications are to be made. In this example, five times (t1, t2, t3, t4, and t5) indicated by open circles in (a) of FIG. 10 are determined as the times of the frequency signals to which the phase modifications are to be made.

Here, note that the phase of the frequency signal at the reference time t0 is expressed as follows.

$$\psi(t_0)=\text{mod } 2\pi(\arctan(y(t_0)/x(t_0))) \quad \text{(Equation 6)}$$

Also note that the phases of the to-be-modified frequency signals at the five times are expressed as follows.

$$\psi(t_i)=\text{mod } 2\pi(\arctan(y(t_i)/x(t_i))) \ (i=1, 2, 3, 4, 5) \quad \text{(Equation 7)}$$

Each of the phases before the modifications is indicated by X in (a) of FIG. 10. Also, the magnitudes of the frequency signals at these times can be expressed as follows.

$$P(t_i)=\sqrt{x(t_i)^2+y(t_i)^2} \ (i=1, 2, 3, 4, 5) \quad \text{(Equation 8)}$$

Figure 11:
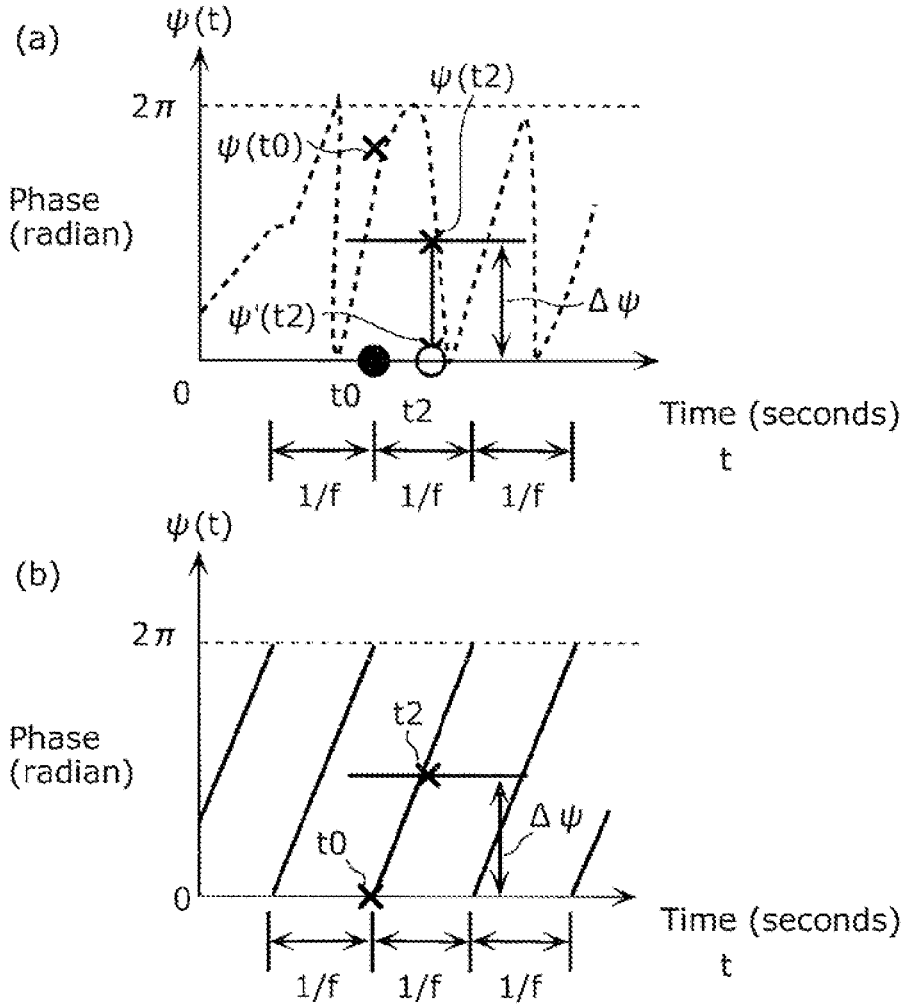
FIG. 11 is a diagram explaining a phase modification process.

FIG. 11 shows a method of modifying the phase of the frequency signal at the time t2. The details in (a) of FIG. 11 are the identical to those in (a) of FIG. 10. In (b) of FIG. 11, the phase cyclically fluctuating from 0 to 2π (radian) at a constant angular velocity in a cycle of 1/f (where f is the analysis-target frequency) is drawn by a solid line. The modified phase is expressed as follows.

$$\psi'(t_i)\ (i=0, 1, 2, 3, 4, 5)$$

In (b) of FIG. 11, as compared with the phase at the reference time t0, the phase at the time t2 is larger than the phase at the time t0 by Δψ which is expressed as follows.

$$\Delta\psi=2\pi f(t_2-t_0) \quad \text{(Equation 9)}$$

Thus, in order to modify this phase difference caused by a time difference between the phases at the times t0 and t2, a phase ψ'(t2) is calculated by subtracting Δψ from the phase ψ(t2) at the time t2. This obtained phase is the modified phase at the time t2. Here, since the phase at the time t0 is the phase at the reference time, the value of the present phase remains the same after the phase modification. To be more specific, the phase to be obtained after the phase modification is calculated by the following equations.

$$\psi'(t_0)=\psi(t_0) \quad \text{(Equation 10)}$$

$$\psi'(t_i)=\text{mod } 2\pi(\psi(t_i)-2\pi f(t_i-t_0))\ (i=1, 2, 3, 4, 5) \quad \text{(Equation 11)}$$

The phases of the frequency signals obtained as a result of the phase modifications are indicated by X in (b) in FIG. 10. The representations in (b) of FIG. 10 are the same as those in (a) in FIG. 10 and, therefore, the explanation is not repeated.

Next, the phase curve calculation unit 3005 (*j*) calculates the temporal phase fluctuations as a curve, using the phase information obtained by the phase modification unit 3003 (*j*) as a result of the modifications.

Returning to FIG. 8, the frequency signal selection unit 3004 (*j*) selects the frequency signals which are to be used by the phase curve calculation unit 3005 (*j*) for calculating the phase curve, from among the frequency signals, in the predetermined period, to which the phase modification unit 3003 (*j*) has made the phase modifications (step S103 (*j*)). In this example, the analysis-target time is t0, and the phase curve is calculated from the phases of the frequency signals at the times t1 to t5 with respect to the phase at the time t0. Here, the number of frequency signals (six signals in total at the times t0 to t5) used for calculating the phase curve is equal to or greater than a predetermined value. This is because it would be difficult to determine the regularity of the temporal phase fluctuations when the number of frequency signals selected for the phase curve calculation is small. The time length of the predetermined period may be determined on the basis of characteristics of the temporal phase fluctuations of the extracted sound.

Next, the phase curve calculation unit 3005 (*j*) calculates the phase curve (step S104 (*j*)). Note that the phase curve is calculated via approximation according to, for example, a quadratic polynomial expressed as follows.

$$\psi(t)=A_2t^2+A_1t+A_0 \quad \text{(Equation 12)}$$

Figure 12:
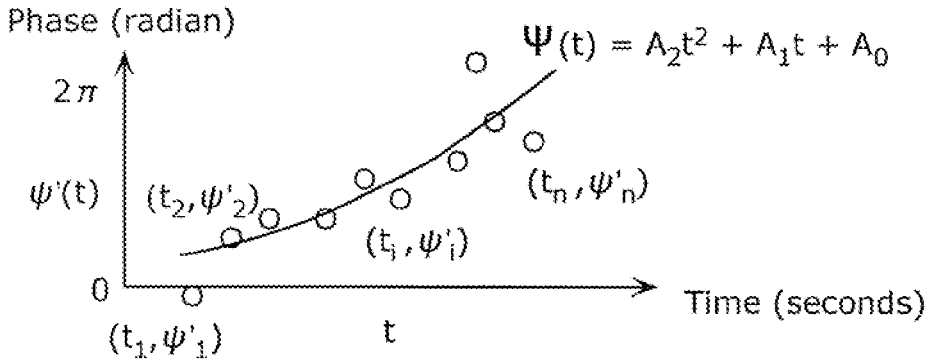
FIG. 12 is a diagram explaining a process of calculating a phase curve.

FIG. 12 is a diagram explaining a process of calculating the phase curve. As shown in FIG. 12, a quadratic curve can be calculated from the predetermined number of points. In the present embodiment, the quadratic curve is calculated as a multiple regression curve. To be more specific, when the modified phase at a time $t_i$ (where i=0, 1, 2, 3, 4, and 5) is represented as $\psi'(t_i)$, coefficients $A_2$, $A_1$, and $A_0$ of the quadratic curve ψ(t) are represented as follows.

$$A_2=\frac{S_{(t\times t,\psi)}\times S_{(t,t)}-S_{(t,\psi)}\times S_{(t,t\times t)}}{S_{(t,t)}\times S_{(t\times t,t\times t)}-S_{(t,t\times t)}\times S_{(t,t\times t)}} \quad \text{(Equation 13)}$$

$$A_1=\frac{S_{(t,\psi)}\times S_{(t\times t,t\times t)}-S_{(t\times t,\psi)}\times S_{(t,t\times t)}}{S_{(t,t)}\times S_{(t\times t,t\times t)}-S_{(t,t\times t)}\times S_{(t,t\times t)}} \quad \text{(Equation 14)}$$

$$A_0=\frac{\sum\psi'_i}{n}-A_1\times\frac{\sum t_i}{n}-A_2\times\frac{\sum(t_i)^2}{n} \quad \text{(Equation 15)}$$

Moreover, coefficients in the above equations are expressed as follows.

$$S_{(t,t)}=\sum(t_i\times t_i)-\frac{\sum t_i\times\sum t_i}{n} \quad \text{(Equation 16)}$$

$$S_{(t,\psi)}=\sum(t_i\times\psi'(t_i))-\frac{\sum t_i\times\sum\psi'(t_i)}{n} \quad \text{(Equation 17)}$$

$$S_{(t,t\times t)}=\sum(t_i\times t_i\times t_i)-\frac{\sum t_i\times\sum(t_i\times t_i)}{n} \quad \text{(Equation 18)}$$

$$S_{(t\times t,\psi)}=\sum(t_i\times t_i\times\psi'(t_i))-\frac{\sum(t_i\times t_i)\times\sum\psi'(t_i)}{n} \quad \text{(Equation 19)}$$

$$S_{(t\times t,t\times t)}=\sum(t_i\times t_i\times t_i\times t_i)-\frac{\sum(t_i\times t_i)\times\sum(t_i\times t_i)}{n} \quad \text{(Equation 20)}$$

Returning to FIG. 8, on the basis of the amount of increase in the phase detected from the phase curve calculated by the phase curve calculation unit 3005 (*j*) (j=1 to M), the acceleration-deceleration determination unit 3006 (*j*) (j=1 to M) determines whether the number of engine revolutions is increasing or decreasing, that is, whether the vehicle is accelerating or decelerating. (step S105 (*j*)). In other words, the acceleration-deceleration determination unit 3006 (*j*) determines whether the vehicle is accelerating or decelerating, from the curve calculated by the phase curve calculation unit 3005 (*j*). More specifically, acceleration or deceleration is determined on the basis of the direction of a convex formed by the quadratic curve calculated by the phase curve calculation unit 3005 (*j*). When the coefficient $A_2$ obtained by Equation 12 is positive, that is, when the curve is convex downward, it is determined that the number of engine revolutions is increasing and, thus, that the vehicle is accelerating. On the other hand, when the coefficient $A_2$ is negative, that is, when the curve is convex upward, it is determined that the number of engine revolutions is decreasing and, thus, that the vehicle is decelerating.

It should be noted that, in the present embodiment, the phase form is calculated from the phases at the times t1 to t5 with respect to the phase at the analysis-target time t0. For example, when the time t2 is an analysis target time (in other words, the time t2 is set as a time t0'), a phase curve may be newly calculated from phases at times t1', t2', t3', t4', and t5' to determine whether the vehicle is accelerating or decelerating. Alternatively, the phase curve which has been already calculated from the phases at the times t0 to t5 may be used for determining whether the vehicle is accelerating or decelerating. When the latter determination method is used, the amount of calculation can be accordingly reduced. Moreover, the acceleration-deceleration determination does not have to be made for each of the times. A predetermined time period may be set as an analysis target, and the acceleration-deceleration determination may be made for each predetermined time period.

Note that the phase modification unit 3003 (*j*) may further perform the following process during the phase modification. When the following phase modification process is further performed, processes including calculating a phase curve and calculating errors with respect to the phase curve are also performed. Thus, the phase modification unit 3003 (*j*) performs the following process, referring to as necessary the calculation results given by the phase curve calculation unit 3005 (*j*).

Figure 13:
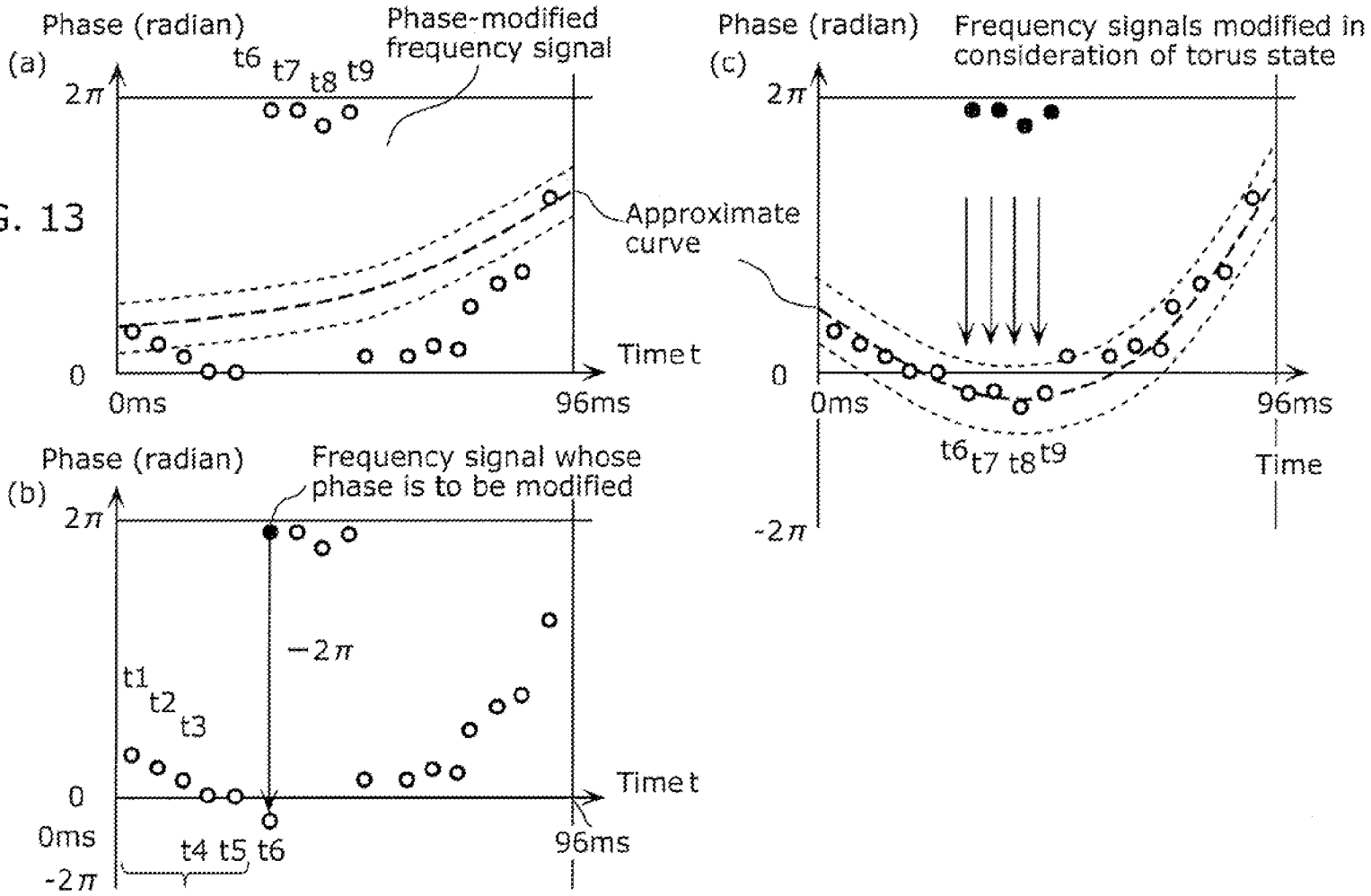
FIG. 13 is a diagram explaining a phase modification process.

FIG. 13 is a diagram explaining the phase modification process which is further performed. Each of graphs shown in FIG. 13 is obtained as a result of the frequency analysis performed on a part of the engine sound. In each of the graphs, the horizontal axis represents time whereas the vertical axis represents phase. In the graphs, open circles indicate the frequency signals obtained as a result of the phase modifications performed by the phase modification unit 3003 (*i*).

In (a) of FIG. 13, when a phase curve is calculated using the phases of the frequency signals indicated by the open circles, a curve indicated by a thick dashed line is obtained as a result. Each of thin dashed lines indicates an error threshold. More specifically, each of the thin dashed lines indicates a boundary between the engine sound and the noise. When a phase is present between the two thin dash lines, this phase belongs to the engine sound. When a phase is present outside the two thin dash lines, this phase belongs to the noise. It can be seen that errors between the calculated phase curve and the frequency signals are significant and that many points are significantly shifted from the threshold. In particular, the phases of the frequency signals at the times t6 to t9 are significantly shifted from the phases at the other times. This is because the phases lie on a torus, cyclically from 0 to $2\pi$. Thus, the phase curve may be calculated, with consideration given to this torus state. With this, the phase significantly shifted from the phases at the other times can be modified, so that curve approximation can be accurately performed on the temporal fluctuations in the phase.

For example, the phase may be modified using an N number of phases which are present before, after, or before and after the present phase. Suppose, as an example, that an average of the phases at the times t1 to t5 (N=5) shown in (b) of FIG. 13 is calculated, and that the average phase is calculated as $\psi=2\pi*10/360$. Also suppose that the phase at the time t6 is $\psi(6)=2\pi*170/360$. Here, since the phases lie on a torus as mentioned above, the phase at the time t6 may possibly be $\psi(6)=(2\pi*170/360)\pm2\pi$. Although there is, in fact, a possibility that "$\pm2\pi$" may be "$\pm2\pi*m$" (where m represents a natural number), the present example considers only the case where m=1. When the frequency fluctuates significantly, so does the phase. On account of this, the value of m may be variable depending on a sound which is to be analyzed. The times selected for calculating the average of the phases are not limited to the times t1 to t5, and any times may be selected.

Next, the phase $\psi(6)$ at the time t6 is modified to a value such that an error between the phase at the time t6 and the average phase $\psi$ becomes smaller. In the case shown in (b) of FIG. 13, $\psi(6)=(2\pi*170/360)-2\pi$. Similarly, the phase at the time t7 is modified using the phases at the times t2 to t5 and the modified phase at the time t6. In the present example, the phase at the time t7 is modified into $\psi(7)=\psi(7)-2\pi$. In this way, the same process is performed on the phases at the times t8, t9, and so on.

In FIG. 13, (c) shows the modified phases. As shown, the phases at the times t6 to t9 have been modified. When the phase curve is calculated using the phase information obtained as a result of the modifications, the curve indicated by a thick dashed line is obtained. In the case shown in (c) of FIG. 13, since all the frequency signals are present between the curve and the threshold, the sound is appropriately extracted as the engine sound.

It should be noted that the phase modification method is not limited to the method described thus far. For example, the phase curve may be firstly calculated, and then the phase modification using $\pm2\pi$ may be performed on each point at which an error with respect to the curve is significant. Alternatively, the range of possible angles for the phase may be modified. The explanation is presented as follows, with reference to the drawing.

Figure 14:
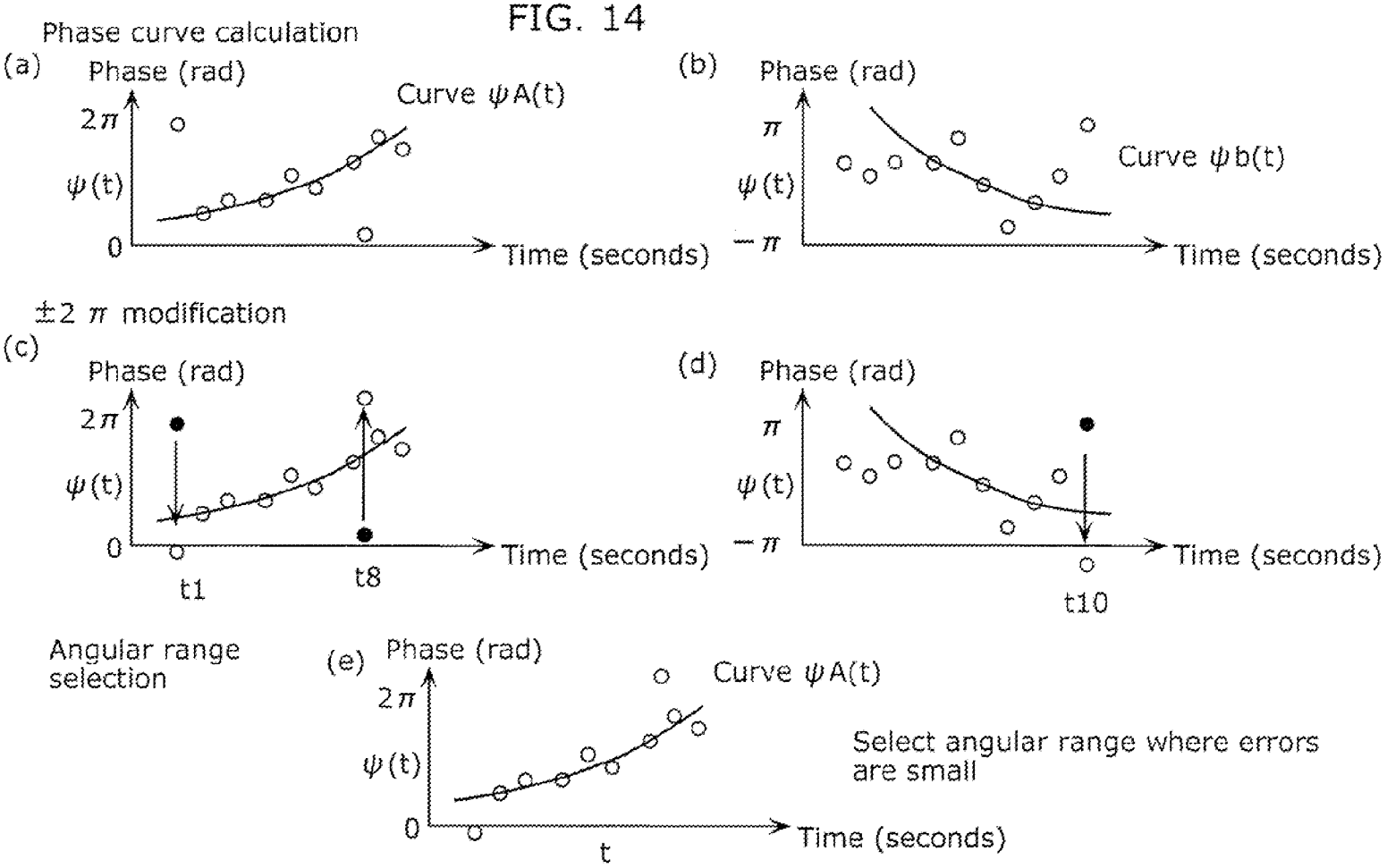
FIG. 14 is a diagram explaining a phase modification process.

FIG. 14 is a diagram explaining a phase modification process. In each of graphs shown in FIG. 14, the vertical axis represents phase whereas the horizontal axis represents time. In the graphs, open circles indicate the phases of the frequency signals at the corresponding times. In FIG. 14, (a) shows the phases of the frequency signals in the case where the angular range is from 0 to $2\pi$. A phase curve has been calculated from the phases, and is indicated by a solid line. In (c) of FIG. 14, the phases are modified on the basis of errors between the curve and the present phases. To be more specific, a phase modification is performed by adding $+2\pi$ to the phase at the time t1. Moreover, a phase modification is performed by adding $-2\pi$ to the phase at the time t8.

In FIG. 14, (b) shows the phases of the frequency signals in the case where the angular range is from $-\pi$ to $\pi$. As in the case shown in (a) of FIG. 14, a phase curve has been calculated from the phases, and is indicated by a solid line. In (d) of FIG. 14, the phase is modified on the basis of an error between the curve and the present phase. To be more specific, a phase modification is performed by adding $-2\pi$ to the phase at the time t10. When the errors are compared between the angular ranges shown in (c) and (d) of FIG. 14, the error in the case of the angular range shown in (c) is smaller. Hence, the phase curve based on the angular range shown in (c) is used. In this way, the angular range may be controlled to calculate the phase curve. As a result, a phase which is significantly shifted from the phases at the other times can be modified, so that the acceleration-deceleration determination can be made with accuracy.

As described thus far, when the number of engine revolutions increases, the frequency of the engine sound increases over time and the phase of the frequency signal of the engine sound increases at an accelerating rate. On the other hand, when the number of engine revolutions decreases, the frequency of the engine sound decreases over time and the phase of the frequency signal of the engine sound decreases at an accelerating rate. Whether the phase increases at an accelerating rate or decreases at an accelerating rate can be determined from phases included in a short time period. Accordingly, with this configuration, whether the number of engine revolutions of the nearby vehicle is increasing or decreasing can be determined in real time. Thus, whether the nearby vehicle is accelerating or decelerating can be determined in real time.

Second Embodiment

The following is a description of a noise elimination device in the second embodiment. This noise elimination device corresponds to a revolution increase-decrease determination device in the claims set forth below.

The first embodiment describes the method of receiving an engine sound and determining, on the basis of temporal phase fluctuations, whether a vehicle is accelerating or decelerating. The present embodiment describes a method of: receiving a mixed sound including an engine sound and a noise such as a wind noise; extracting the engine sound from the mixed sound; and determining, on the basis of temporal phase fluctuations, whether a vehicle is accelerating or decelerating.

Figure 15:
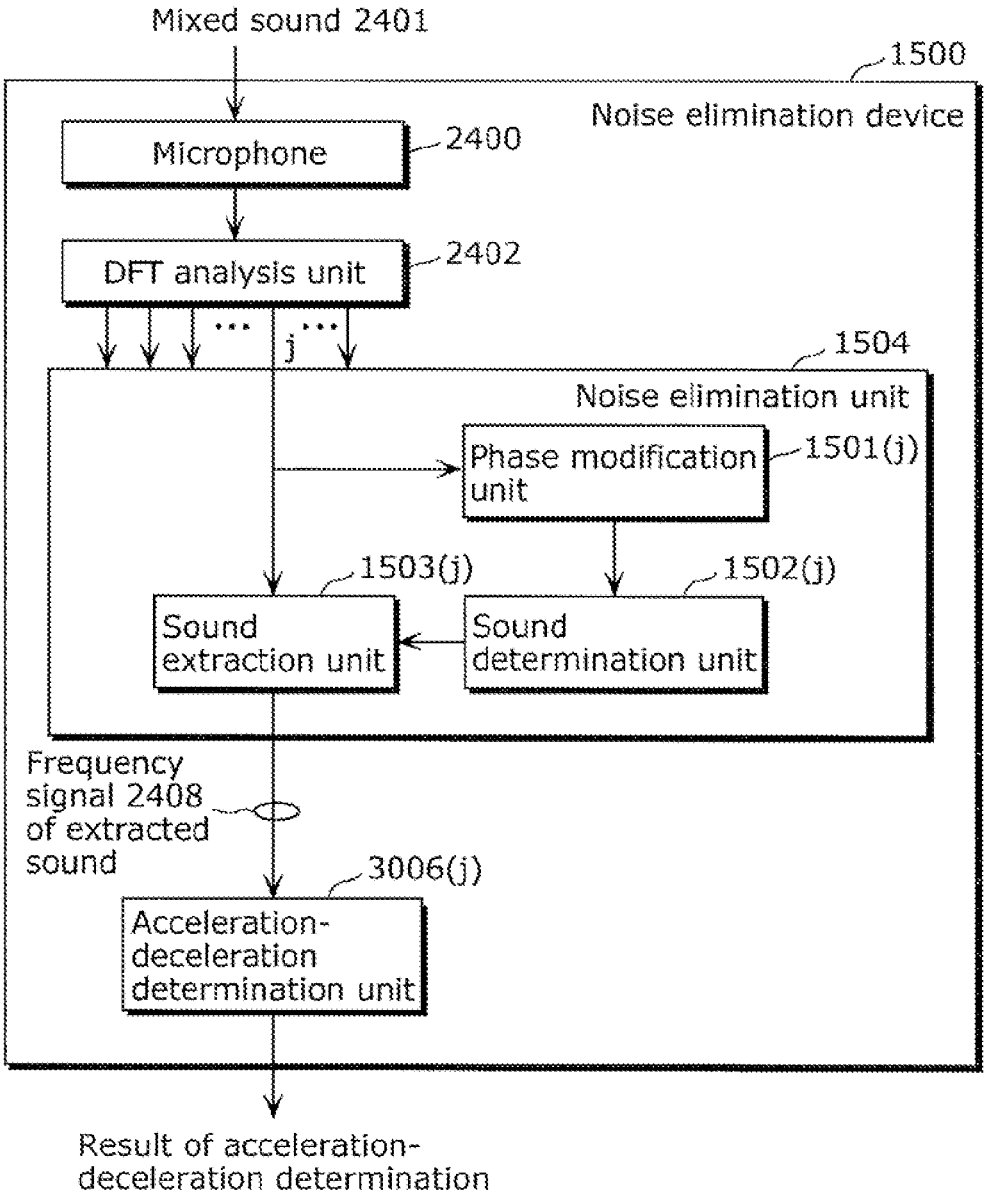
FIG. 15 is a block diagram showing an entire configuration of a noise elimination device in a second embodiment according to the present invention.
Figure 16:
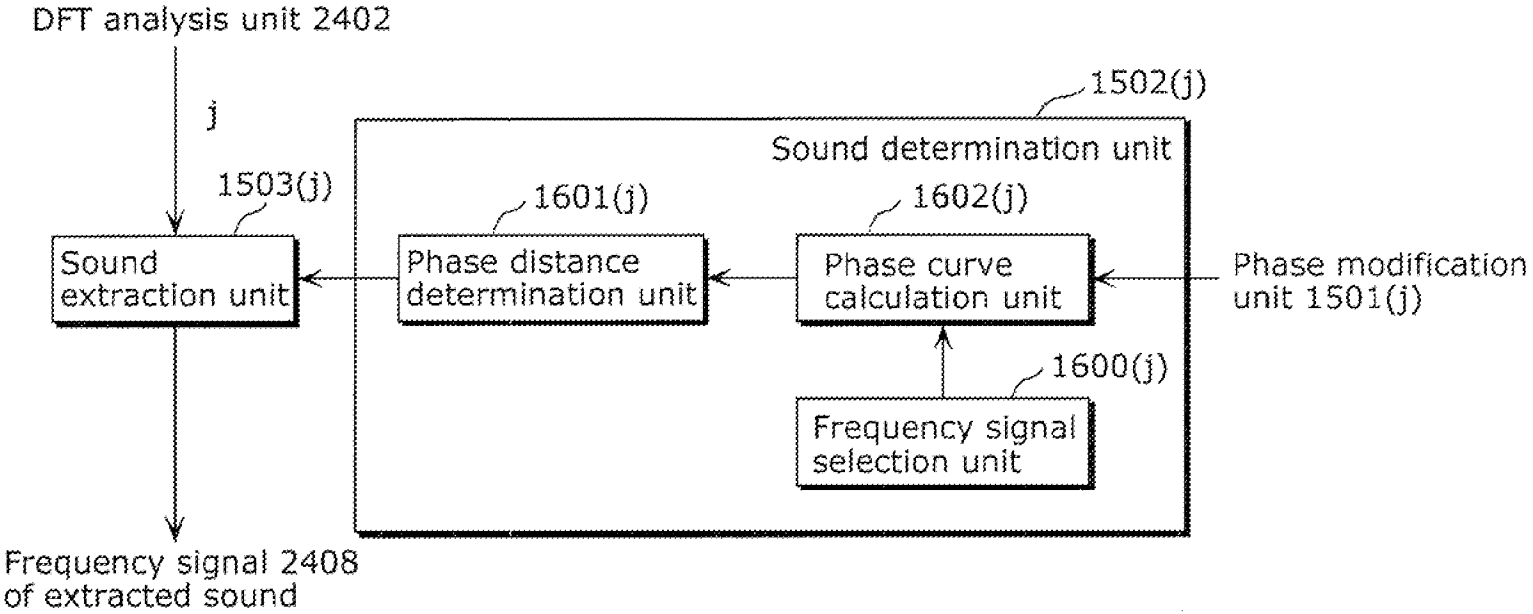
FIG. 16 is a block diagram showing a configuration of a sound determination unit of the noise elimination device in the second embodiment according to the present invention.

FIGS. 15 and 16 are block diagrams each showing a configuration of the noise elimination device in the second embodiment according to the present invention.

In FIG. 15, a noise elimination device 1500 includes a microphone 2400, a DFT analysis unit 2402, a noise elimination processing unit 1504, and an acceleration-deceleration determination unit 3006 (*j*).

The DFT analysis unit 2402 performs the same processing as the processing performed by the DFT analysis unit 3002 shown in FIG. 7. Therefore, the detailed description is not repeated here.

Hereinafter, the number of frequency bands obtained by the DFT analysis unit 2402 is represented as M and a number identifying is a frequency band is represented as a symbol j (j=1 to M).

The noise elimination processing unit 1504 includes a phase modification unit 1501 (*j*) (j=1 to M), a sound determination unit 1502 (*j*) (j=1 to M), and a sound extraction unit 1503 (*j*) (j=1 to M). The sound extraction unit 1503 (*j*) corresponds to a sound signal identification unit in the claims set forth below.

Supposing that a phase of the frequency signal at a time t is represented as $\psi(t)$ (radian), the phase modification unit 1501 (*j*) (j=1 to M) makes a phase modification to the frequency signal of the frequency band j obtained by the DFT analysis unit 2402. To be more specific, the phase $\psi(t)$ of the frequency signal at the time t is modified to $\psi(t)=\mathrm{mod}\ 2\pi(\psi(t)-2\pi ft)$ (where f is the analysis-target frequency).

The sound determination unit 1502 (*j*) (j=1 to M) calculates a phase curve (an approximate curve) by approximating temporal phase fluctuations using a phase-modified signal at an analysis-target time in a predetermined period, and then calculates an error between the calculated phase curve and the phase at the analysis-target time. Here, the number of frequency signals used for calculating a phase distance (i.e., the error between the phase curve and the phase at the analysis-target time) is equal to or greater than a first threshold value. The phase distance is calculated using $\psi'(t)$.

On the basis of the error (i.e., the phase distance) calculated by the sound determination unit 1502 (*j*), the sound extraction unit 1503 (*j*) (j=1 to M) extracts a frequency signal whose error is equal to or smaller than a second threshold.

The acceleration-deceleration determination unit 3006 (*j*) (j=1 to M) performs the acceleration-deceleration determination only on the engine sound extracted by the sound extraction unit 1503 (*j*) (j=1 to M). More specifically, on the basis of the amount of increase in the phase detected from the phase curve calculated by the phase curve calculation unit 3005 (*j*) (j=1 to M), the acceleration-deceleration determination unit 3006 (*j*) (j=1 to M) determines whether the number of engine revolutions is increasing or decreasing, that is, whether the vehicle is accelerating or decelerating.

These processes are performed while the predetermined period is being shifted in the direction of the time axis. Accordingly, a frequency signal 2408 of the extracted sound can be extracted for each time-frequency domain.

Then, the acceleration-deceleration determination unit 3006 (*j*) determines whether the vehicle is accelerating or decelerating on the basis of a form (to be more specific, a direction of a convex) of the phase curve representing the extracted engine sound. More specifically, the acceleration-deceleration determination unit 3006 (*j*) (j=1 to M) performs the acceleration-deceleration determination only on the engine sound extracted by the sound extraction unit 1503 (*j*) (j=1 to M), on the basis of the amount of increase in the phase detected from the phase curve calculated by the phase curve calculation unit 3005 (*j*) (j=1 to M).

FIG. 16 is a block diagram showing a configuration of the sound determination unit 1502 (*j*) (j=1 to M).

The sound determination unit 1502 (*j*) (j=1 to M) includes a frequency signal selection unit 1600 (*j*) (j=1 to M), a phase distance determination unit 1601 (*j*) (j=1 to M), and a phase curve calculation unit 1602 (*j*) (j=1 to M). The phase distance determination unit 1601 (*j*) corresponds to an error calculation unit in the claims set forth below.

The frequency signal selection unit 1600 (*j*) (j=1 to M) selects frequency signals which are to be used for calculating a phase curve and phase distances, from among the frequency signals, in the predetermined period, to which the phase modification unit 1501 (*j*) (j=1 to M) has made phase modifications.

The phase curve calculation unit 1602 (*j*) (j=1 to M) calculates, as a quadratic curve, a phase form which fluctuates over time, using the modified phase $\psi'(t)$ of the frequency signal selected by the frequency signal selection unit 1600 (*j*) (j=1 to M). Following this, the phase distance determination unit 1601 (*j*) (j=1 to M) determines a phase distance between the phase curve calculated by the phase curve calculation unit 1602 (*j*) (j=1 to M) and the modified phase $\psi'$ (t) at the analysis-target time.

Next, an operation performed by the noise elimination device 1500 configured as described thus far is explained.

In the following, the j-th frequency band is described. The same processing is performed for the other frequency bands. Here, the explanation is given, as an example, about the case where a center frequency and an analysis-target frequency of the frequency band agree with each other. The analysis-target frequency refers to a frequency f as in $\psi'(t)=\mathrm{mod}\ 2\pi(\psi)(t)-2\pi ft)$ used in calculating the phase distance. In this case, whether or not a to-be-extracted sound exists in the frequency f is determined. As another method, the to-be-extracted sound may be determined using a plurality of frequencies including the frequency band as the analysis frequencies. In such a case, whether or not the to-be-extracted sound exists in the frequencies around the center frequency can be determined.

Figure 17:
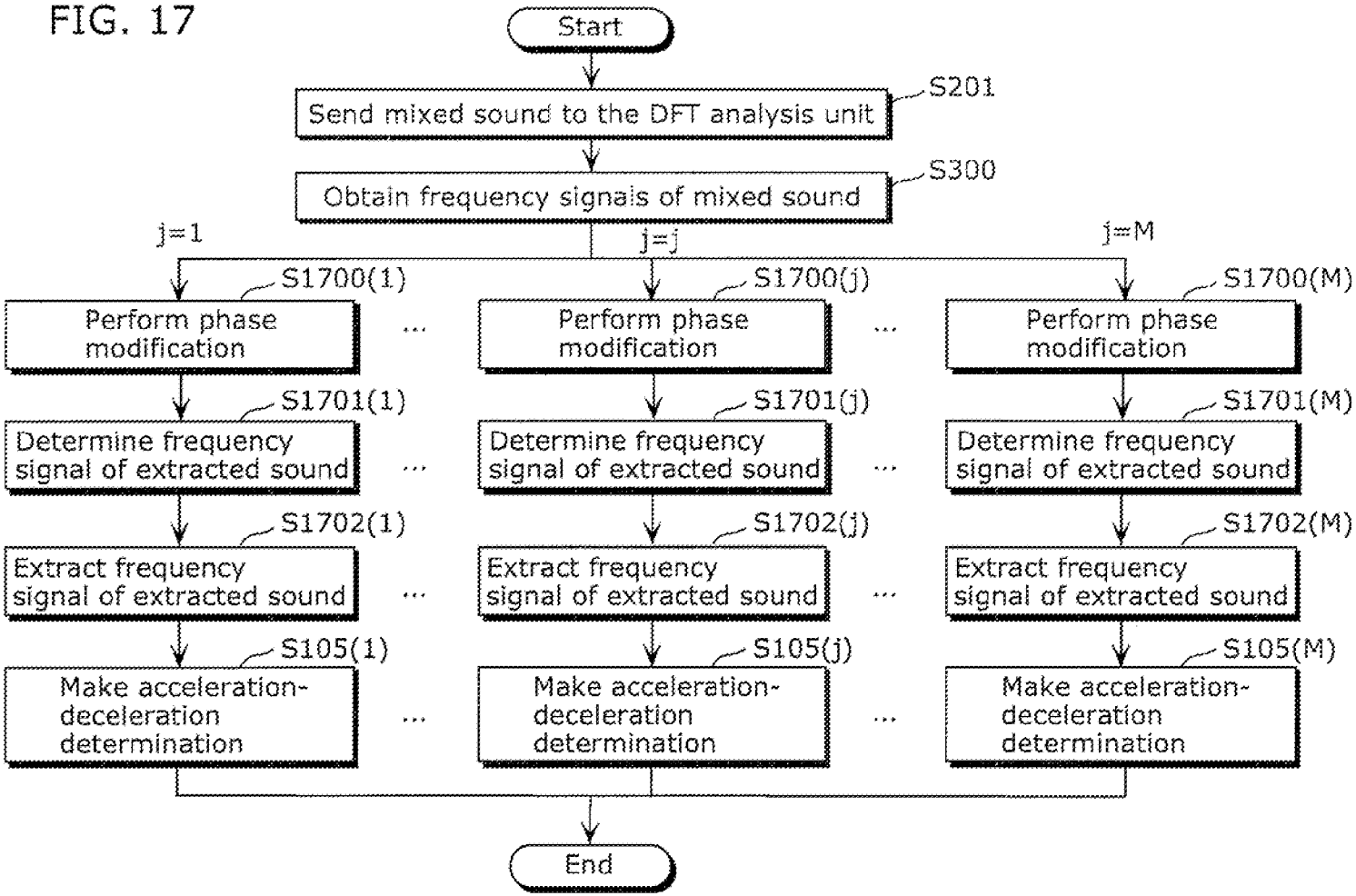
FIG. 17 is a flowchart showing an operational procedure executed by the noise elimination device in the second embodiment according to the present invention.
Figure 18:
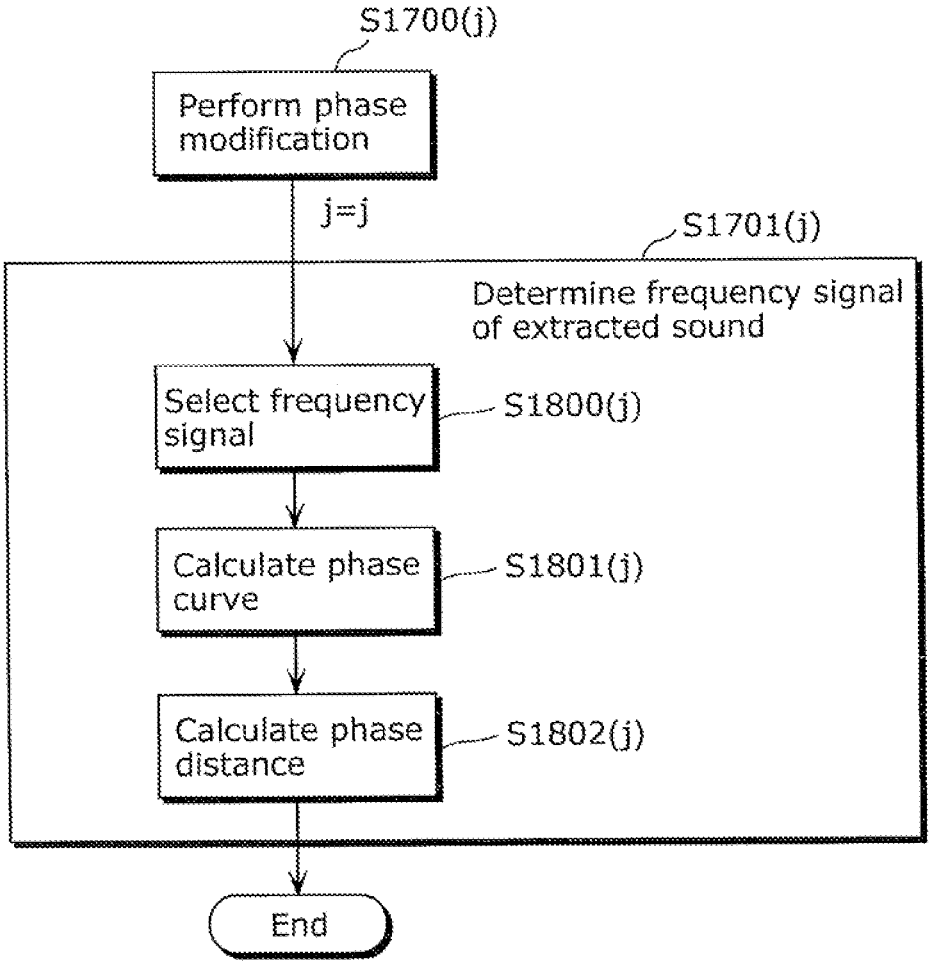
FIG. 18 is a flowchart showing an operational procedure performed in a process to determine a frequency signal of the extracted sound in the second embodiment according to the present invention.

FIGS. 17 and 18 are flowcharts each showing an operational procedure executed by the noise elimination device 1500.

Firstly, the microphone 2400 collects a mixed sound 2401 from the outside and then outputs the collected mixed sound 2401 to the DFT analysis unit 2402 (step S200).

Receiving the mixed sound 2401, the DFT analysis unit 2402 performs the Fourier transform processing on the mixed sound 2401 to obtain a frequency signal of the mixed sound 2401 for each frequency band j (step S300).

Next, supposing that the phase of the frequency signal at the time t is represented as $\psi(t)$ (radian), the phase modification unit 1501 (*j*) (j=1 to M) makes a phase modification to the frequency signal of the frequency band j obtained by the DFT analysis unit 2402 to convert the phase $\psi(t)$ into the phase $\psi'(t)=\mathrm{mod}\ 2\pi(\psi(t)-2\ \pi ft)$ (where f is the analysis-target frequency) (step S1700 (*j*)).

The following explains a reason why the phase is used in the present invention, with reference to the drawings.

Figure 19:
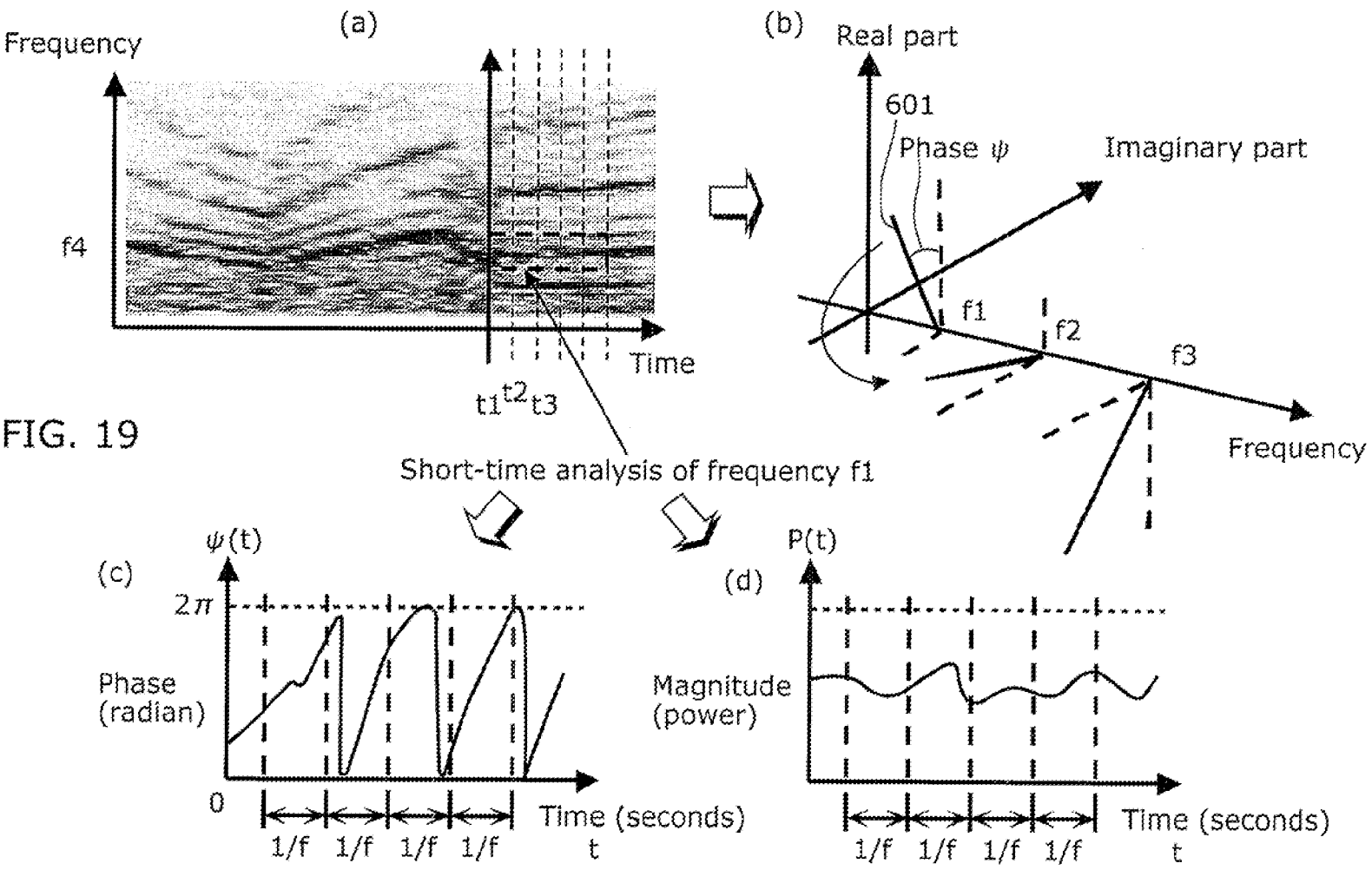
FIG. 19 is a diagram explaining a frequency analysis.

FIG. 19 is a diagram explaining about power and phase in the DFT analysis. As is the case with FIG. 3, (a) of FIG. 19 is a spectrogram obtained as a result of the DFT analysis performed on the engine sound of the vehicle.

In FIG. 19, (b) is a diagram showing a frequency signal 601 in a complex space using the Hanning window with a predetermined time window width measured from a time t1. A power and a phase are calculated for each of the frequencies such as frequencies f1, f2, and f3. A length of the frequency signal 601 indicates the power, and an angle which the frequency signal 601 forms with the real axis indicates the phase.

Then, the frequency signal is obtained for each of the times while the time shift is being executed as shown by t1, t2, t3, and so on in (a) of FIG. 19. In general, the spectrogram shows only the power of the frequency at each of the times and omits the phase. Thus, each of the spectrograms shown in FIG. 3 and (a) of FIG. 19 shows only the magnitude of power obtained as a result of the DFT analysis.

In FIG. 19, (c) shows temporal phase fluctuations of a predetermined frequency (a frequency f4, for example) shown in (a) in FIG. 19. The horizontal axis represents time. The vertical axis represents the phase of the frequency signal, and the phase is represented by a value from 0 to $2\pi$ (radian).

In FIG. 19, (d) shows temporal power fluctuations of the predetermined frequency (the frequency f4, for example) shown in (a) in FIG. 19. The horizontal axis represents time whereas the vertical axis represents the magnitude (power) of the frequency signal.

Figure 20:
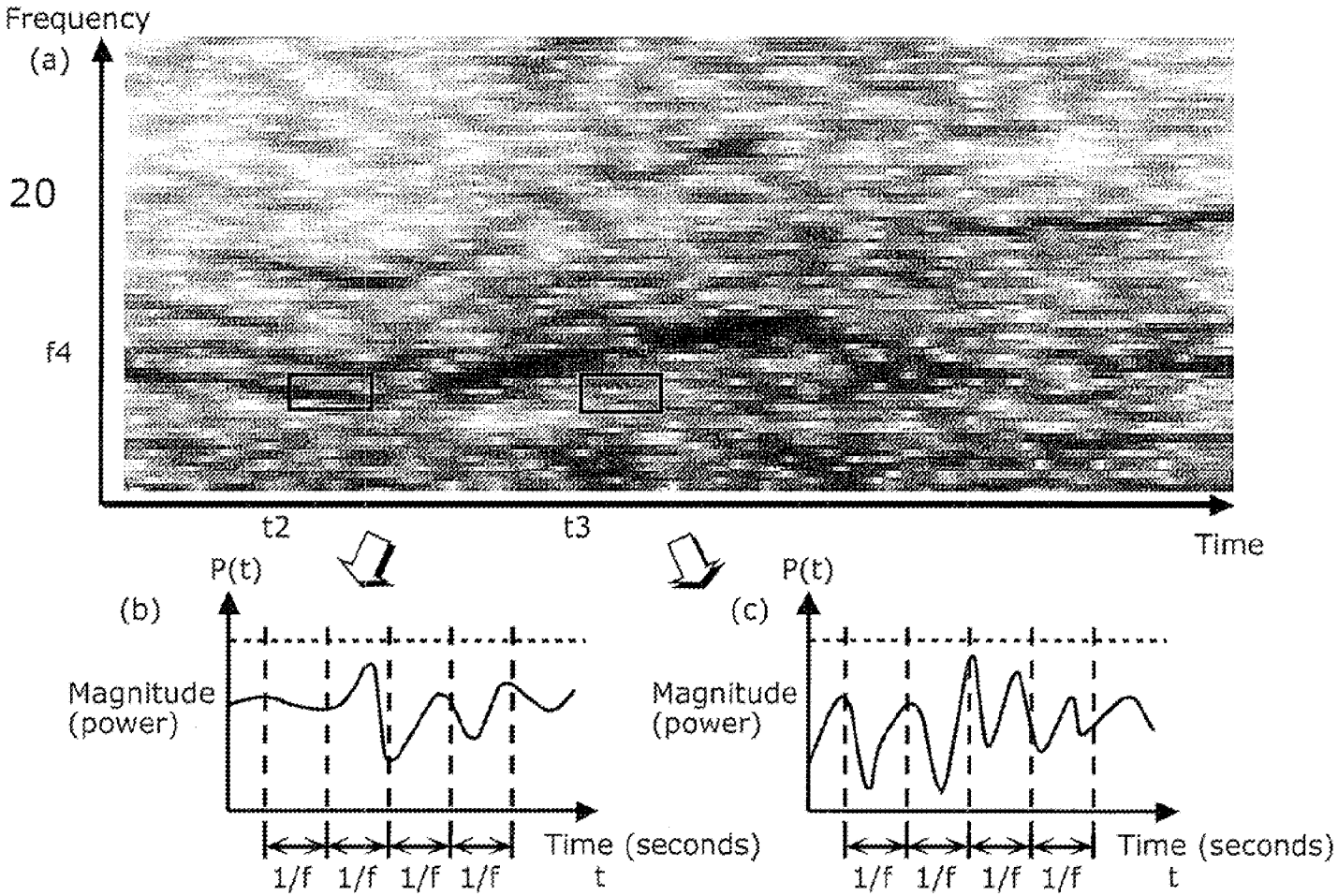
FIG. 20 is a diagram explaining an engine sound and a wind noise.

FIG. 20 is a diagram explaining an engine sound of a vehicle when a noise such as a wind noise is present. In FIG. 20, (a) shows a spectrogram obtained as a result of the DFT analysis performed on the engine sound of the vehicle, as in FIG. 3. The horizontal axis represents time whereas and the vertical axis represents frequency. The color density of the spectrogram represents the magnitude of power of the frequency signal. Note that the spectrogram in FIG. 20 is different from the one shown in FIG. 3 in that a noise such as a wind noise is included in the spectrogram shown in FIG. 20. Therefore, there are darker parts in frequencies other than the frequency of the engine sound. This makes it difficult to determine, only from the power, whether the engine sound or the wind noise is present.

In FIG. 20, (b) is a graph showing temporal fluctuations in power of the frequency f4 including the engine sound at the time t2 in the predetermined period. As can be seen, the power is erratic due to the wind noise. In FIG. 20, (c) is a graph showing temporal fluctuations in power of the frequency f4 including no engine sound at the time t3 in the predetermined period. It can be seen that unsteady power is present. By a comparison between the graphs shown in (b) and (c) of FIG. 20, it is still difficult to determine, only from the power, whether the wind noise or the engine sound is present.

With this being the situation, the engine sound is extracted using the temporal phase fluctuations in the present invention. Firstly, phase characteristics of the engine sound is explained.

In an engine, a predetermined number of cylinders make piston motion to cause revolutions to a powertrain. The engine sound from the vehicle includes: a sound dependent on the engine revolutions; and a fixed vibration sound or an aperiodic sound which is independent of the engine revolutions. In particular, the sound mainly detected from the outside of the vehicle is the periodic sound dependent on the engine revolutions. In the present invention, this periodic sound dependent on the engine revolutions is extracted as the engine sound.

It can be seen from FIG. 3, as the number of engine revolutions fluctuates, the frequency of the engine sound fluctuates. Here, attention is focused on the fluctuations in the frequency. As can be seen, the frequency seldom randomly fluctuates and is seldom discretely scattered. The frequency fluctuates, almost according to the passage of time in the predetermined period. Thus, the engine sound can be approximated according to the piecewise linear function represented by Equation 4 above. To be more specific, the frequency f at the time t can be linearly approximated using a line segment which increases or decreases from an initial value $f_0$ in proportion to the time t (i.e., a proportionality coefficient A) in a predetermined time period.

When the frequency f is expressed by Equation 4 above, the phase $\psi$ at the time t can be expressed by Equation 5 above.

The phase modification unit 1501 (*j*) performs the phase modification process to ease the approximation performed on the temporal phase fluctuations. More specifically, the phase modification unit 1501 (*j*) makes a phase modification to the frequency signal shown in (c) of FIG. 19 to convert the phase $\psi(t)$ into the phase $\psi'(t)=\text{mod } 2\pi(\psi)(t)-2\pi ft)$ (where f is the analysis-target frequency).

This phase modification process is the same as the phase modification process executed by the phase modification unit 3003 (*j*) in the first embodiment. The details are described with reference to FIGS. 10 and 11 and, therefore, the description is not repeated here.

Returning to FIG. 17, the sound determination unit 1502 (*j*) calculates a form of the phase using the phase information obtained by the phase modification unit 1501 (*j*) as a result of the modifications. Then, the sound determination unit 1502 (*j*) calculates the phase distances (i.e., errors) between the frequency signal at the analysis-target time and the frequency signals at a plurality of times other than the analysis-target time (step S1701 (*j*)).

FIG. 18 is a flowchart showing an operational procedure performed in the process (step S1701 (*j*)) of determining the frequency signal of the extracted sound.

A frequency signal selection process (S1800 (*j*)) and a phase curve calculation process (S1801 (*j*)) are the same as the frequency signal selection process (S103 (*j*) in FIG. 8) and a phase curve calculation process (S104 (*j*) in FIG. 8), respectively, described in the first embodiment. Therefore, the detailed descriptions are not repeated here.

Returning to FIG. 18, the phase distance determination unit 1601 (*j*) calculates the phase distances from the form calculated by the phase curve calculation unit 1602 (*j*) (step S1802 (*j*)). In the present example, a phase distance (i.e., an error) $E_0$ is a difference error between the phases, and is calculated as follows.

$$E_0=|\Psi(t_0)-\psi'(t_0)| \quad \text{(Equation 21)}$$

It should be noted that the analysis-target point may be excluded in calculating the form of the phase, and that a phase difference between the calculated form and the analysis-target point may be calculated. With this method, when a noise shifted significantly from the calculated form is included in the analysis-target point, the form can be approximated more accurately.

It should be noted that, in the present example, the phase form is calculated from the phases at the times t1 to t5 with respect to the phase at the analysis-target time t0. For example, when the time t2 is an analysis target time (in other words, the time t2 is set as a time t0'), a phase curve may be newly calculated from phases at times t1', t2', t3', t4', and t5' to calculate an error. Alternatively, the phase curve which has been already calculated from the phases at the times t0 to t5 may be used for calculating the error. To be more specific, the error calculated using the already-calculated phase curve is expressed as follows.

$$E_i=|\Psi(t_i)-\psi'(t_i) \quad \text{(Equation 22)}$$

With this method, the number of times to calculate the phase curve is reduced, so that the amount of calculation can be accordingly reduced. Moreover, a predetermined period may be set as an analysis target, and it may be determined, on the basis of an average of errors, whether all of the frequency signals included in the analysis-target period have errors. For example, the average of the errors may be expressed as follows.

$$E = \frac{1}{n}\sum_{k=1}^{n} |\Psi(t_k) - \psi'(t_k)| \quad \text{(Equation 23)}$$

Returning to FIG. 17, the sound extraction unit 1503 (*j*) extracts, as the extracted sound, each of the analysis-target frequency signals each having a phase distance (i.e., an error) equal to or smaller than the threshold (step S1702 (*j*)).

Then, the acceleration-deceleration determination unit 3006 (*j*) determines whether the vehicle is accelerating or decelerating, on the basis of the form (i.e., the direction of the convex) of the phase curve of the extracted engine sound part (step S105 (*j*)).

Figure 21:
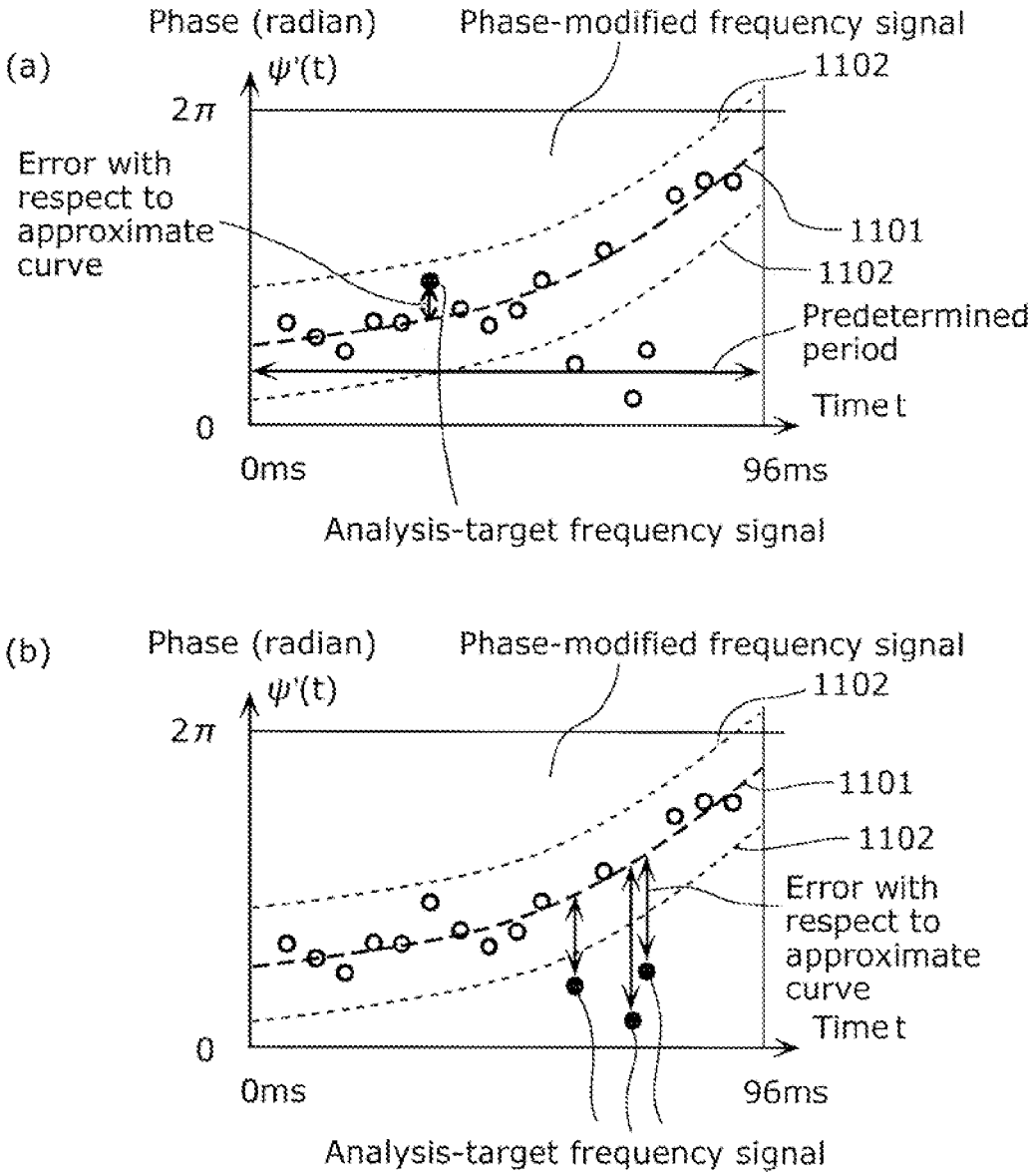
FIG. 21 is a diagram explaining a process of calculating a phase distance.

FIG. 21 is a diagram schematically showing the modified phase ψ'(t) of the frequency signal of the mixed sound in a predetermined period (96 ms) for which the phase distance is calculated. The horizontal axis represent the time t whereas the vertical axis represents the modified phase ψ'(t). A filled circle indicates the phase of the analysis-target frequency signal. Open circles indicate the phases of the frequency signals used for calculating the phase curve. A thick dashed line 1101 is the calculated phase curve. It can be seen that a quadratic curve is calculated, as the phase curve, from the phase-modified points. Each thin dashed line 1102 indicates an error threshold (20 degrees, for example). More specifically, the upper dashed line 1102 is shifted upward from the dashed line 1101 by the threshold degrees whereas the lower dashed line 1102 is shifted downward from the dashed line 1101 by the threshold degrees. When the phase of the analysis-target frequency signal is present between the two dashed lines 1102, the present frequency signal is determined to be a frequency signal of the to-be-extracted sound (i.e., the periodic sound). When the phase of the analysis-target frequency signal is not present between the two dashed lines 1102, the present frequency signal is determined to be a frequency signal of the noise.

In (a) of FIG. 21, an error between the phase of the analysis-target frequency signal indicated by the filled circle and the quadratic curve of the phase is smaller than the threshold. Thus, the sound extraction unit 1503 (*j*) extracts this frequency signal as the frequency signal of the to-be-extracted sound. In (b) of FIG. 21, each error between the phases of the analysis-target frequency singles indicated by the filled circles and the quadratic curve of the phase is greater than the threshold. Thus, instead of extracting these signals as the frequency signals of the to-be-extracted sound, the sound extraction unit 1503 (*j*) eliminates these frequency signals as noises.

Figure 22:
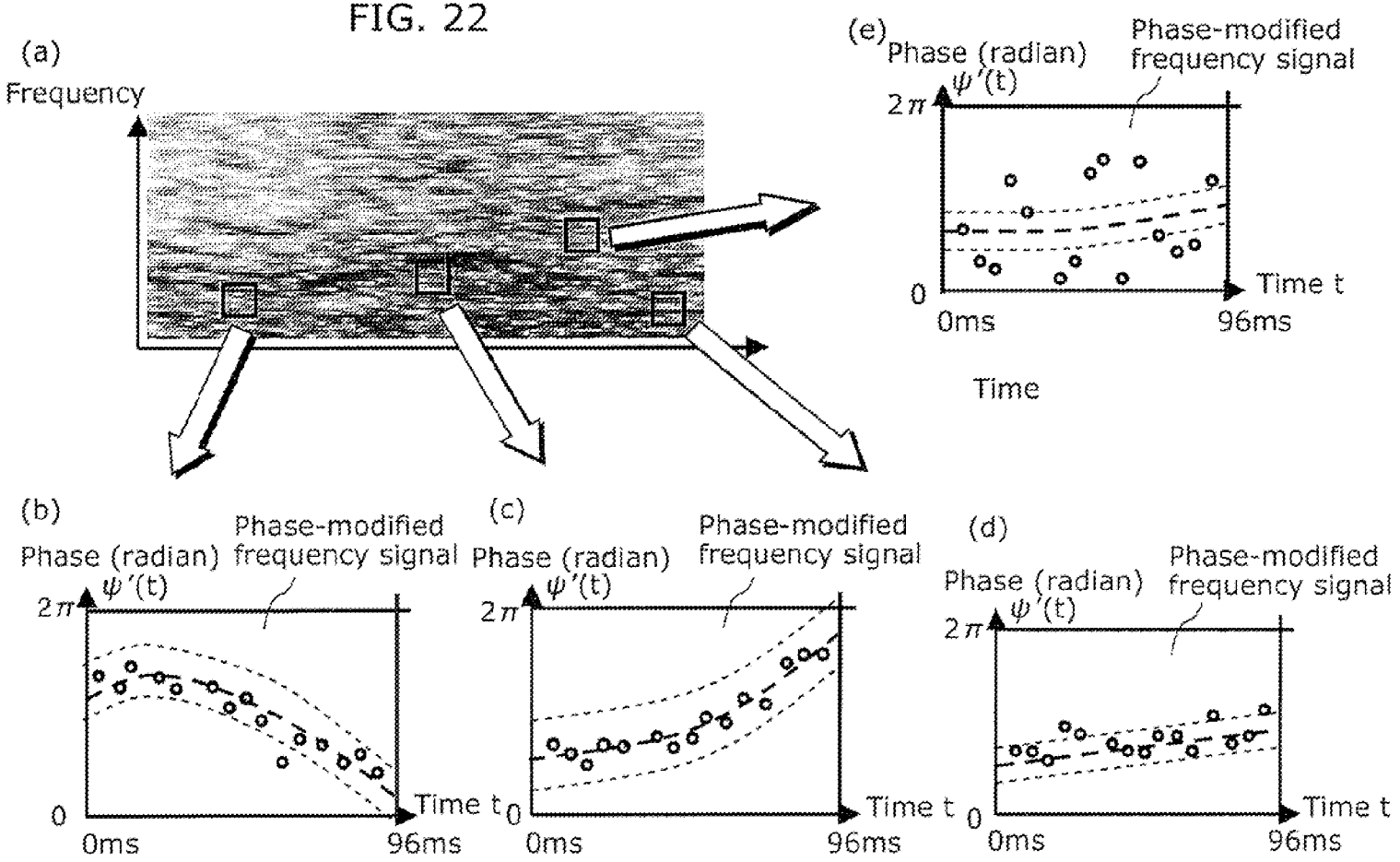
FIG. 22 is a diagram explaining a phase curve of an engine sound.

FIG. 22 is a diagram explaining a process of extracting the engine sound according to the method described in the present embodiment. When the engine sound is approximated by the piecewise linear function as expressed by Equation 4, the phase can be approximated by the quadratic curve as expressed by Equation 12.

In FIG. 22, (a) shows the same spectrogram that is shown in (a) of FIG. 19. In FIG. 22, (b) to (e) are graphs respectively showing frequency signals included in four areas indicated by squares in (a) of FIG. 22. Each of the areas has one frequency band. In each of the graphs shown in (b) to (e) of FIG. 22, the horizontal axis represents time whereas the vertical axis represents phase. Also, in each of the graphs, open circles indicate the frequency signals which have been actually analyzed and a thick dashed line indicates the calculated approximate curve. Moreover, each thin dashed line indicates a threshold between a to-be-extracted sound and a noise.

In (b) of FIG. 22, the number of engine revolutions is decreasing. This graph shows the modified phase of the engine sound part which can be approximated by a linear expression representing the temporal frequency fluctuations as a negative slope in the time-frequency domain. As can be seen from this graph, the phase curve is convex upward. Also, almost all the analyzed frequency signals are present between the thin dashed lines each indicating the threshold.

In (c) of FIG. 22, the number of engine revolutions is increasing. This graph shows the modified phase of the engine sound part which can be approximated by a linear expression representing the temporal frequency fluctuations as a positive slope in the time-frequency domain. As can be seen from this graph, the phase curve is convex downward. Also, almost all the analyzed frequency signals are present between the thin dashed lines each indicating the threshold.

In (d) of FIG. 22, the number of engine revolutions is constant. This graph shows the modified phase of the engine sound part which can be approximated by a quadratic coefficient which is zero where the frequency does not fluctuate in the time-frequency domain. A second-order term of the phase curve is 0 and, as can be seen, the graph is a straight line. Also, almost all the analyzed frequency signals are present between the thin dashed lines each indicating the threshold. From this graph, the engine sound including a sound part whose frequency does not fluctuate can be identified using a quadratic curve.

In (e) of FIG. 22, the graph shows the modified phase of the wind noise part. The phase of the frequency signal of the wind noise is erratic. For this reason, even when an approximate quadratic curve is calculated, an error between the phase and the curve is significant. Thus, as can be seen, only a few signals are present between the thin dashed lines each indicating the threshold.

As described thus far, the wind noise and the engine sound can be discriminated on the basis of the calculated curve and the error with respect to the curve.

Figure 23:
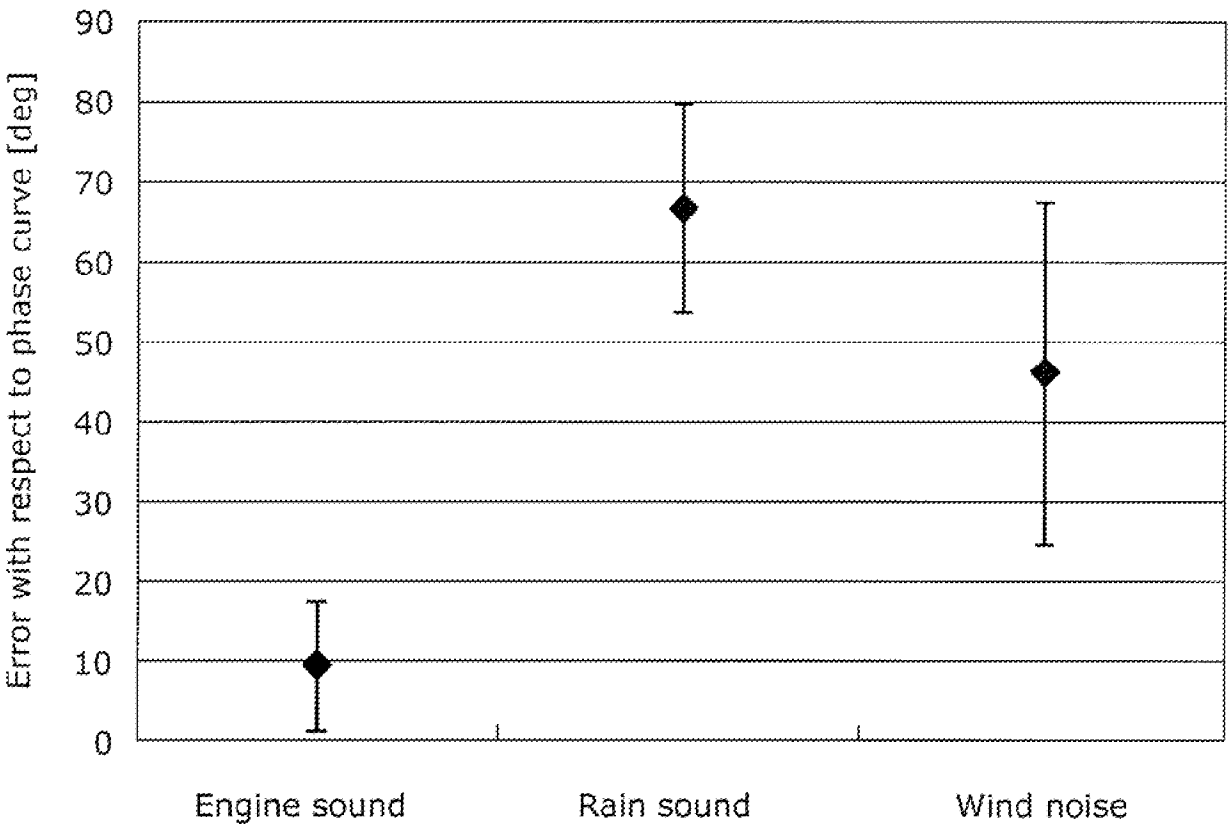
FIG. 23 is a diagram explaining an error with respect to the phase curve.

FIG. 23 a diagram explaining an error with respect to the phase curve. The horizontal axis represent sound signals of an engine sound, a rain sound, and a wind noise. The vertical axis represents an average and distribution of errors with respect to the phase curve calculated according to the present method. To be more specific, a width of a line segment shown in the vertical axis indicates a range of allowable errors, and a rhombus indicates the average. In the case of the engine sound, for example, the range of allowable errors is from 1 degree to 18 degrees and the average of errors is 10 degrees.

Analysis conditions are that: frequency analyses are performed at 256 points (32 ms) of each of the sounds sampled at 8 kHz; and a phase curve calculation is performed using 768 points as a period (96 ms). Then, the average and distribution of the errors with respect to the phase curve are calculated. As shown in FIG. 23, the error average value of the engine sound with respect to the phase curve is 10 degrees which is small while the error average values of the rain sound and wind noise are 68 degrees and 48 degrees, respectively, which are large. It can be understood that there is a significant difference in the error with respect to the phase curve between the periodic sound such as an engine sound and the aperiodic sound such as a wind noise. In the present embodiment, the threshold is set at, for example, 20 degrees so that a sound having an error equal to or smaller than the threshold is appropriately extracted as an engine sound.

Figure 24:
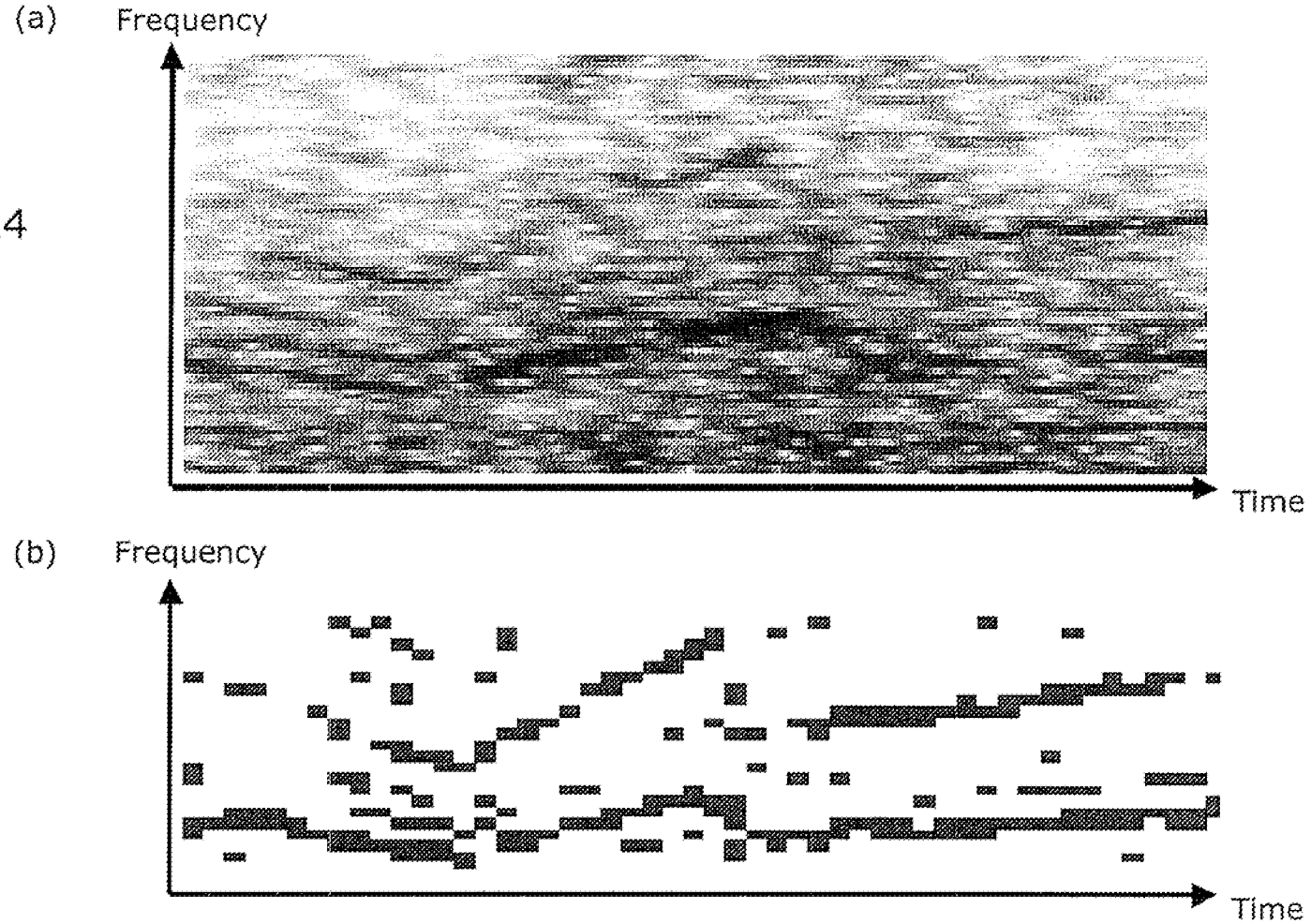
FIG. 24 is a diagram explaining a process of extracting an engine sound.

FIG. 24 is a diagram explaining sound identification. In each of graphs shown in FIG. 24, the horizontal axis represents time whereas the vertical axis represents frequency. In FIG. 24, (a) shows a spectrogram obtained as a result of frequency analysis performed on a sound including both a wind noise and an engine sound. The color density of the spectrogram represents the magnitude of power. When the color is darker, the power is greater. Analysis conditions are that: frequency analyses are performed at 512 points of the sound sampled at 8 kHz; and a phase curve calculation is performed using 1536 points as a period. The threshold of an error with respect to the phase curve is set at 20 degrees, and then the engine sound is extracted.

In FIG. 24, (b) shows a graph in which the wind noise and the engine sound are identified according to the method described in the present embodiment. The darker parts indicate the extracted engine sound. The graph shown in (a) of FIG. 24 includes noises such as a wind noise. Thus, it is difficult to extract, from this graph, the engine sound. However, according to the method in the present embodiment, it can be seen that the engine sound is appropriately extracted. In particular, the present method can extract sound parts where the number of engine revolutions suddenly increases and decreases, as well as a steady sound.

As described thus far, the present embodiment can discriminate between the engine sound and the noises including wind, rain, and background noises for each time-frequency domain. This means that, by eliminating the noises, an increase or decrease in the number of engine revolutions, that is, an increase or decrease in acceleration of the nearby vehicle, can be determined only from the engine sound. Accordingly, the accuracy of determination can be improved.

Third Embodiment

The following is a description of a vehicle detection device in the third embodiment. This vehicle detection device corresponds to a revolution increase-decrease determination device in the claims set forth below.

The vehicle detection device in the third embodiment determines a frequency signal of an engine sound (i.e., a to-be-extracted sound) from each of mixed sounds received by a plurality of microphones, calculates an arrival direction of an approaching vehicle from a sound arrival time difference, and informs a driver about the direction and presence of the approaching vehicle. Here, the vehicle detection device informs the driver only about the direction and the presence of the approaching vehicle which is accelerating, and does not inform the driver about the direction and presence of the approaching vehicle which is decelerating or running at a constant speed.

Figure 25:
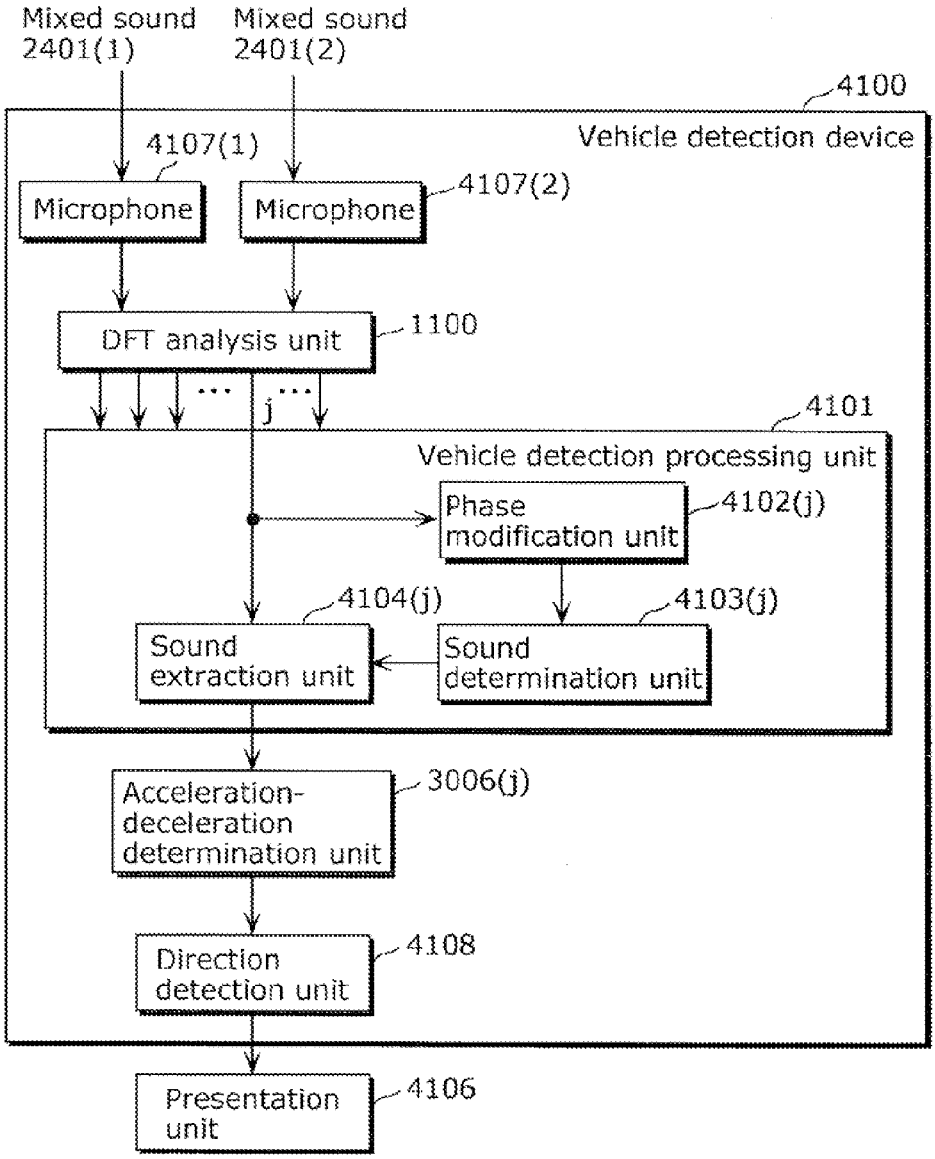
FIG. 25 is a block diagram showing an entire configuration of a vehicle detection device in a third embodiment according to the present invention.
Figure 26:
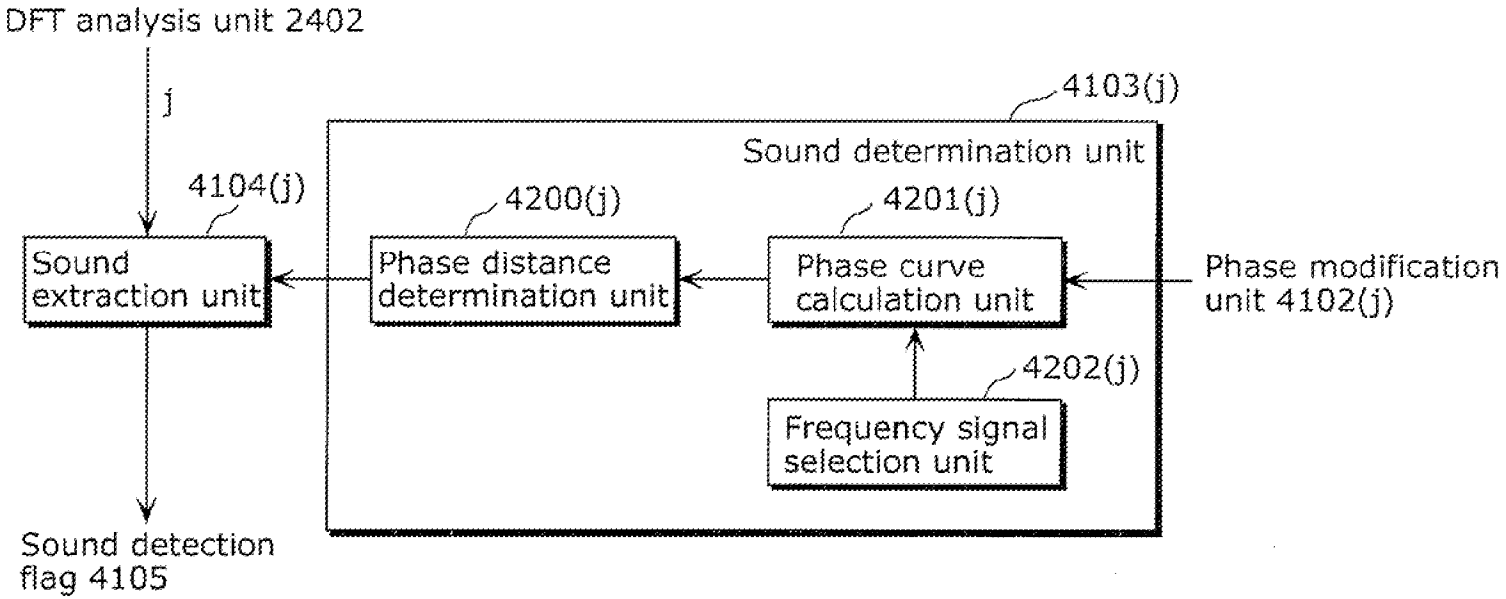
FIG. 26 is a block diagram showing a configuration of a sound determination unit of the vehicle detection device in the third embodiment according to the present invention.

FIGS. 25 and 26 are diagrams each showing a configuration of the vehicle detection device in the third embodiment according to the present invention.

In FIG. 25, a vehicle detection device 4100 includes a microphone 4107 (1), a microphone 4107 (2), a DFT analysis unit 1100, a vehicle detection processing unit 4101, an acceleration-deceleration determination unit 3006 (*j*) (j=1 to M), and a direction detection unit 4108.

The vehicle detection processing unit 4101 includes a phase modification unit 4102 (*j*) (j=1 to M), a sound determination unit 4103 (*j*) (j=1 to M), a sound extraction unit 4104 (*j*) (j=1 to M), the direction detection unit 4108, and a presentation unit 4106.

In FIG. 26, the sound determination unit 4103 (*j*) (j=1 to M) includes a phase distance determination unit 4200 (*j*) (j=1 to M), a phase curve calculation unit 4201 (*j*) (j=1 to M), and a frequency signal selection unit 4202 (*j*) (j=1 to M). The phase distance determination unit 4200 (*j*) corresponds to an error calculation unit in the claims set forth below.

The microphone 4107 (1) shown in FIG. 25 receives a mixed sound 2401 (1) from the outside. The microphone 4107 (2) shown in FIG. 25 receives a mixed sound 2401 (2) from the outside. In the present example, the microphone 4107 (1) and the microphone 4107 (2) are set on left and right front bumpers, respectively. Each of the mixed sounds includes an engine sound of a vehicle and a wind noise sampled at, for example, 8 kHz. It should be noted that a sampling frequency is not limited 8 kHz.

The DFT analysis unit 1100 performs the discrete Fourier transform processing on the mixed sound 2401 (1) and the mixed sound 2401 (2) to obtain the respective frequency signals of the mixed sound 2401 (1) and the mixed sound 2401 (2). In this example, the time window width for the DFT is 256 points (38 ms). Hereinafter, the number of frequency bands obtained by the DFT analysis unit 1100 is represented as M and a number specifying a frequency band is represented as a symbol j (j=1 to M). In this example, a frequency band from 10 Hz to 500 Hz where an engine sound of a vehicle exists is divided into 10-Hz bands (M=50) to obtain the frequency signal.

Supposing that a phase of a frequency signal at a time t is $\psi(t)$ (radian), the phase modification unit 4102 (*j*) (j=1 to M) modifies the phase $\psi(t)$ of the frequency signal of the frequency band j (j=1 to M) obtained by the DFT analysis unit 1100 to a phase $\psi''(t)=\mathrm{mod}\ 2\pi(\psi(t)-2\pi f' t)$ (where f' is a frequency of the frequency band). In the present example, the phase $\psi(t)$ is modified using the frequency f' of the frequency band where the frequency signal is obtained, instead of using the analysis-target frequency.

The sound determination unit 4103 (*j*)=1 to M) calculates the phase curve from the phase-modified frequency signal at an analysis-target time in a predetermined period, and then determines a to-be-extracted sound on the basis of the calculated phase curve. Here, the number of frequency signals used for calculating a phase distance is equal to or greater than a first threshold value. In the present example, the predetermined period is 96 ms. Also, the phase distance is calculated using $\psi''(t)$. The sound determination unit 4103 (*j*) (j=1 to M) performs the same processing as the processing performed by the sound determination unit 1502 (*j*) (j=1 to M) in the second embodiment. Therefore, the detailed description is not repeated here.

FIG. 26 is a block diagram showing a configuration of the sound determination unit 4103 (*j*) (j=1 to M).

The sound determination unit 4103 (*j*)=1 to M) includes a phase distance determination unit 4200 (*j*) (j=1 to M), a phase curve calculation unit 4201 (*j*) (j=1 to M), and a frequency signal selection unit 4202 (*j*) (j=1 to M).

The frequency signal selection unit 4202 (*j*) (j=1 to M) selects frequency signals which are to be used for calculating a phase curve and phase distances, from among the frequency signals, in the predetermined period, to which the phase modification unit 4102 (*j*) (j=1 to M) has made phase modifications. The frequency signal selection unit 4202 (*j*) (j=1 to M) performs the same processing as the processing performed by the frequency signal selection unit 1600 (*j*) (j=1 to M) in the second embodiment. Therefore, the detailed description is not repeated here.

The phase curve calculation unit 4201 (*j*) (j=1 to M) calculates, as a curve, a phase form which fluctuates over time, using the modified phase ψ"(t) of the frequency signal. The phase curve calculation unit 4201 (*j*) (j=1 to M) performs the same processing as the processing performed by the phase curve calculation unit 1602 (*j*) (j=1 to M) in the second embodiment. Therefore, the detailed description is not repeated here.

The phase distance determination unit 4200 (*j*) (j=1 to M) determines whether a phase distance with respect to the phase curve calculated by the phase curve calculation unit 4201 (*j*) (j=1 to M) is equal to or smaller than a second threshold. To be more specific, the phase curve calculation is performed using 768 points as a period (96 ms), and the phase distance is calculated. The phase distance determination unit 4200 (*j*) (j=1 to M) employs the same methods for calculating the phase curve and phase distance as those employed by the phase distance determination unit 1601 (*j*) (j=1 to M) in the second embodiment. Therefore, the detailed description is not repeated here.

Next, the sound extraction unit 4104 (*j*) (j=1 to M) extracts the engine sound on the basis of the phase distance determined by the sound determination unit 4103 (*j*) (j=1 to M). To be more specific, the threshold of error is set at 20 degrees, and then a sound having an error equal to or smaller than the threshold is extracted as the engine sound. The sound extraction unit 4104 (*j*) (j=1 to M) performs the same processing as the sound extraction unit 1503 (*j*) (j=1 to M) in the second embodiment. Therefore, the detailed description is not repeated here. It should be noted that, when the engine sound is extracted, the sound extraction unit 4104 (*j*) (j=1 to M) also outputs a sound detection flag 4105.

Returning to FIG. 25, according to the presence or absence of the sound detection flag 4105, the acceleration-deceleration determination unit 3006 (*j*) (j=1 to M) performs the acceleration-deceleration determination only on the engine sound extracted by the sound extraction unit 4104 (*j*). More specifically, on the basis of the amount of increase in the phase detected from the phase curve calculated by the phase curve calculation unit 4201 (*j*), the acceleration-deceleration determination unit 3006 (*j*) determines whether the number of engine revolutions is increasing or decreasing, that is, whether the nearby vehicle is accelerating or decelerating.

The direction detection unit 4108 identifies a direction in which the nearby vehicle is present, for the time-frequency domain of the extracted engine sound. The direction detection unit 4108 detects the direction of the nearby vehicle on the basis of, for example, a sound arrival time difference. For example, when either one of the microphones extracts the engine sound, the direction of the nearby vehicle is identified using both of the microphones. This is because the wind noise is not uniformly detected by both of the microphones, that is, one of the microphones detects the wind noise while the other microphone does not. It should be noted that the direction may be identified when the engine sound is detected by both of the microphones.

Moreover, the direction detection unit 4108 outputs the result of detecting the direction of the nearby vehicle only when the acceleration-deceleration determination unit 3006 (*j*) determines that the number of engine revolutions is increasing (i.e., it is determined that the nearby vehicle is accelerating).

Suppose that a spacing between the microphone 4107 (1) and the microphone 4107 (2) is d(m). Also suppose that an engine sound is detected from an angle θ (radian) with respect to the driver's vehicle. In this case, the angle θ (radian) can be expresses by Equation 24 as follows, where a sound arrival time difference is represented as Δt(s) and a sound speed is represented as c (m/s).

$$\theta=\sin^{-1}(\Delta tc/d) \quad \text{(Equation 24)}$$

Finally, the presentation unit 4106 connected to the vehicle detection device 4100 informs the driver about the direction of the nearby vehicle detected by the direction detection unit 4108. For example, the presentation unit 4106 may show, on a display, the direction from which the nearby vehicle is approaching. Here, the direction detection unit 4108 outputs only the direction of the nearby vehicle whose number of engine revolutions is determined as being increasing. Thus, the presentation unit 4106 can inform the driver only about the direction of the accelerating vehicle.

The vehicle detection device 4100 and the presentation unit 4106 performs these processes while the predetermined period is being shifted in the direction of the time axis.

Next, an operation performed by the vehicle detection device 4100 configured as described thus far is explained.

In the following, the j-th frequency band (where the frequency is f') is described.

Figure 27:
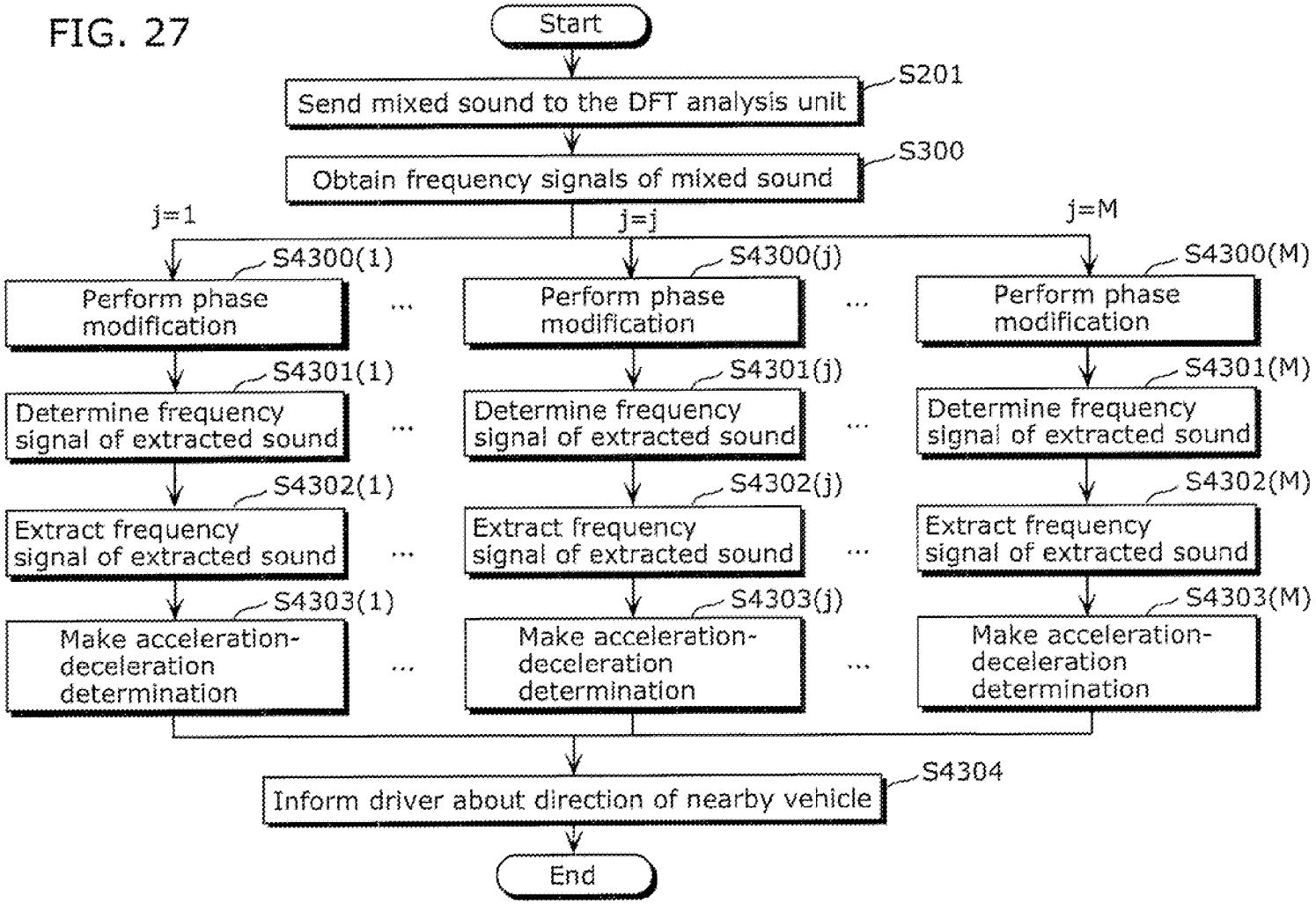
FIG. 27 is a flowchart showing an operational procedure executed by the vehicle detection device in the third embodiment according to the present invention.
Figure 28:
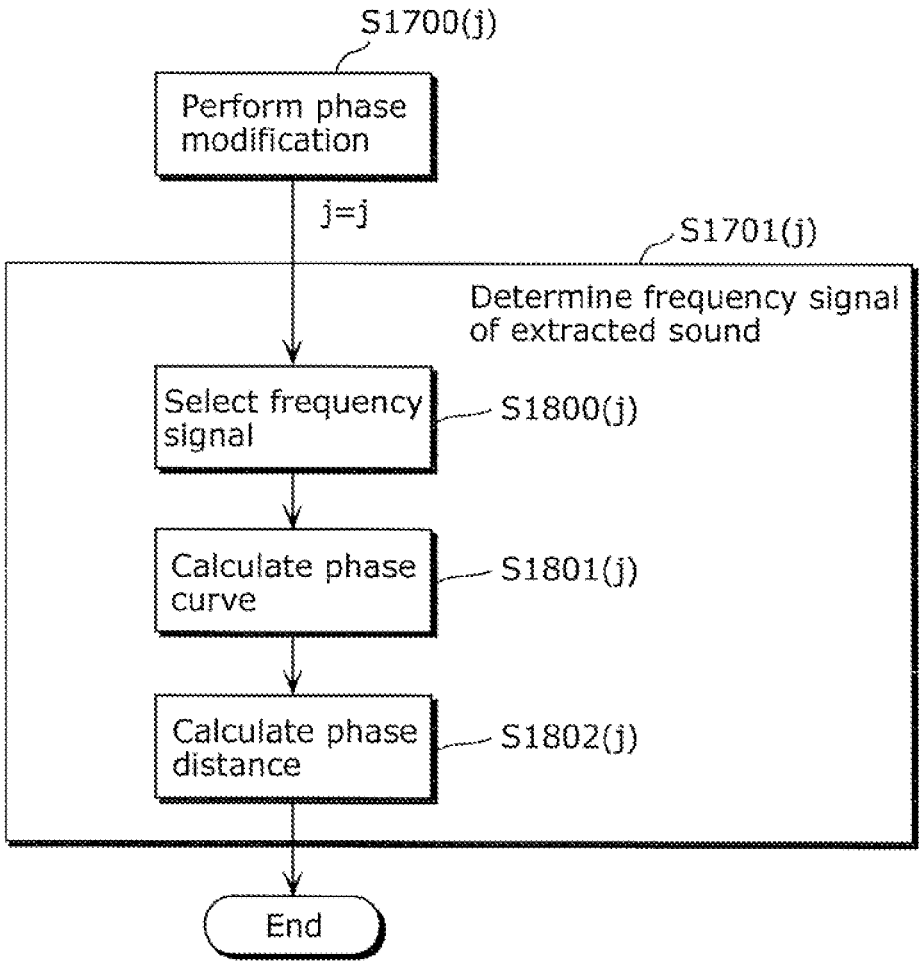
FIG. 28 is a flowchart showing an operational procedure performed in a process to determine a frequency signal of the extracted sound in the third embodiment according to the present invention.

FIGS. 27 and 28 are flowchart each showing an operational procedure performed by the vehicle detection device 4100.

Firstly, each of the microphone 4107 (1) and the microphone 4107 (2) receives the mixed sound 2401 from the outside, and sends the received mixed sound to the DFT analysis unit 2402 (step S201).

Receiving the mixed sound 2401 (1) and the mixed sound 2401 (2), the DFT analysis unit 1100 performs the discrete Fourier transform processing on the mixed sound 2401 (1) and the mixed sound 2401 (2) to obtain the respective frequency signals of the mixed sound 2401 (1) and the mixed sound 2401 (2) (step S300).

Supposing that a phase of a frequency signal at a time t is ψ(t) (radian), the phase modification unit 4102 (*j*) modifies the phase ψ(t) of the frequency signal of the frequency band j (the frequency f') obtained by the DFT analysis unit 1100 to a phase ψ"(t)=mod 2π(ψ(t)−2πf' t) (where f' is the frequency of the frequency band) (step S4300 (*j*)).

Next, the sound determination unit 4103 (*j*) (the phase distance determination unit 4200 (*j*)) determines the analysis-target frequency f, for each of the mixed sound 2401 (1) and the mixed sound 2401 (2), using the phase ψ"(t) of the phase-modified frequency signals in the predetermined period. Here, the number of phase-modified signals is equal to or greater than the first threshold. Also, the first threshold is represented by a value which corresponds to 80% of the frequency signals at the times in the predetermined period. Then, the sound determination unit 4103 (*j*) (the phase distance determination unit 4200 (*j*)) calculates the phase distance using the determined analysis-target frequency f (step S4301 (*j*)).

The process performed in step S4301 (*j*) is described in detail with reference to FIG. 28. Firstly, the frequency signal selection unit 4202 (*j*) selects frequency signals which are to be used by the phase curve calculation unit 4201 (*j*) for calculating a phase form, from among the frequency signals, in a predetermined period, to which the phase modification unit 4102 (*j*) has made phase modifications (step S1800 (*j*)).

Following this, the phase curve calculation unit 4201 (*j*) calculates the phase curve (step S1801 (*j*)).

Next, the phase distance determination unit 4200 (*j*) calculates the phase distance between the form calculated by the phase curve calculation unit 4201 (*j*) and the modified phase at the analysis-target time (step S1802 (*j*)).

Returning to FIG. 27, the sound extraction unit 4104 (*j*) determines, as the frequency signal of the engine sound, the frequency signal whose phase distance is equal to or smaller than the second threshold in the predetermined period (step S4302 (*j*)). It should be noted that, when the engine sound is extracted, the sound extraction unit 4104 (*j*) (j=1 to M) also outputs the sound detection flag 4105.

According to the presence or absence of the sound detection flag 4105, the acceleration-deceleration determination unit 3006 (*j*) (j=1 to M) performs the acceleration-deceleration determination only on the engine sound extracted by the sound extraction unit 4104 (*j*). More specifically, on the basis of the amount of increase in the phase detected from the phase curve calculated by the phase curve calculation unit 4201 (*j*), the acceleration-deceleration determination unit 3006 (*j*) determines whether the nearby vehicle is accelerating or decelerating (step S4303 (*j*)).

The direction detection unit 4108 identifies the direction in which the nearby vehicle is present, for the time-frequency domain of the engine sound extracted by the sound extraction unit 4104 (*j*), and outputs the result of detecting the direction of the nearby vehicle to the presentation unit 4106 only when the number of engine revolutions is determined as being increasing (i.e., when the nearby vehicle is determined as being accelerating). The presentation unit 4106 informs the driver about the direction of the nearby vehicle detected by the direction detection unit 4108 (step S4304).

As described thus far, the vehicle detection device in the third embodiment can output the result of detecting the direction of a sound source only when the number of engine revolutions is determined as being increasing. Therefore, only in an especially dangerous case such as when an accelerating vehicle is approaching, the driver can be informed of the direction from which the nearby vehicle is approaching.

Although the acceleration-deceleration determination device, the noise elimination device, and the vehicle detection device in the embodiments according to the present invention have been described, the present invention is not limited to these embodiments.

In the above embodiments, the engine sound is extracted as an example. Note that the extraction target in the present invention is not limited to the engine sound. The present invention is applicable in any case as long as the sound is periodic like a human voice, an animal sound, or a motor sound.

In the above embodiments, the sound extraction unit determines, for each frequency signal, whether the signal represents a periodic sound or a noise. However, the sound extraction unit may perform this determination for each predetermined period, and thus may determine whether the frequency signals included in the predetermined period represent a periodic sound or a noise. For example, referencing to FIG. 21, when a proportion of the phases of the frequency signals within the predetermined period whose errors with respect to the quadratic curve calculated by the phase curve calculation unit are below the threshold is equal to or higher than a predetermined proportion, the sound extraction unit may determine all the frequency signals included in this period as belonging to the periodic sound. On the other hand, when the proportion is below the predetermined proportion, the sound extraction unit may determine all the frequency signals included in this period as belonging to the noise.

Moreover, the acceleration-deceleration determination unit may determine whether the number of engine revolutions is increasing or decreasing (whether the nearby vehicle is accelerating or decelerating) only when a temporal phase fluctuation is equal to or smaller than a predetermined threshold. For example, only when an absolute value of a phase difference between adjacent times is equal to or smaller than the predetermined threshold, the above determination may be made. In a case where the nearby vehicle shifts gears, for example, the phase suddenly fluctuates. However, by excluding such a case, the aforementioned determination can be accordingly performed.

In the third embodiment, the direction of the approaching vehicle is informed only when this vehicle is accelerating. However, the direction of the approaching vehicle may be informed when this vehicle is accelerating or running at a constant speed, and the direction of the approaching vehicle may not be informed when this vehicle is decelerating.

Also, to be more specific, each of the above-described devices may be a computer system configured with a microprocessor, a ROM, a RAM, a hard disk drive, a display unit, a keyboard, a mouse, and so forth. The RAM or the hard disk drive stores computer programs. The microprocessor operates according to the computer programs, so that the functions of the components included in the computer system are carried out. Here, note that a computer program includes a plurality of instruction codes indicating instructions to be given to the computer so as to achieve a specific function.

Moreover, some or all of the components included in each of the above-described devices may be realized as a single system Large Scale Integration (LSI). The system LSI is a super multifunctional LSI manufactured by integrating a plurality of components onto a signal chip. To be more specific, the system LSI is a computer system configured with a microprocessor, a ROM, a RAM, and so forth. The RAM stores computer programs. The microprocessor operates according to the computer programs, so that the functions of the system LSI are carried out.

Furthermore, some or all of the components included in each of the above-described devices may be implemented as an IC card or a standalone module that can be inserted into and removed from the corresponding device. The IC card or the module is a computer system configured with a microprocessor, a ROM, a RAM, and so forth. The IC card or the module may include the aforementioned super multifunctional LSI. The microprocessor operates according to the computer programs, so that the functions of the IC card or the module are carried out. The IC card or the module may be tamper resistant.

Also, the present invention may be the methods described above. Each of the methods may be a computer program implemented by a computer, or may be a digital signal of the computer program.

Moreover, the present invention may be the aforementioned computer program or digital signal recorded onto a nonvolatile computer-readable recording medium, such as a flexible disk, a hard disk, a CD-ROM, an MO, a DVD, a DVD-ROM, a DVD-RAM, a Blu-ray Disc (BD)®, and a semiconductor memory. Also, the present invention may be the digital signal recorded onto these nonvolatile recording medium.

Furthermore, the present invention may be the aforementioned computer program or digital signal transmitted via a telecommunication line, a wireless or wired communication line, a network represented by the Internet, and data broadcasting.

Also, the present invention may be a computer system including a microprocessor and a memory. The memory may store the aforementioned computer program and the microprocessor may operate according to the computer program.

Moreover, by transferring the nonvolatile recording medium having the aforementioned program or digital signal recorded thereon or by transferring the aforementioned program or digital signal via the aforementioned network or the like, the present invention may be implemented by an independent different computer system.

Furthermore, the above embodiments and variations may be combined.

The embodiments disclosed thus far only describe examples in all respects and are not intended to limit the scope of the present invention. It is intended that the scope of the present invention not be limited by the described embodiments, but be defined by the claims set forth below. Meanings equivalent to the description of the claims and all modifications are intended for inclusion within the scope of the following claims.

The present invention can be applied to a revolution increase-decrease determination device or the like capable of determining, on the basis of an engine sound of a nearby vehicle, whether the number of engine revolutions of the nearby vehicle is increasing or decreasing.

What is claimed is:

1. A revolution increase-decrease determination device comprising:

a frequency analysis unit configured to calculate, from an engine sound, a frequency signal at a predetermined frequency for each of predetermined time periods;

a revolution determination unit configured to determine whether the number of engine revolutions is increasing or decreasing, by determining whether a phase of the frequency signal is increasing at an accelerating rate over time or decreasing at an accelerating rate over time; and a phase curve calculation unit configured to calculate a phase curve approximating temporal fluctuations in the phase of the frequency signal, wherein the revolution determination unit is configured to determine whether the number of engine revolutions is increasing or decreasing by determining, on the basis of a form of the phase curve, whether the phase of the frequency signal is increasing at the accelerating rate over time or decreasing at the accelerating rate over time.

2. The revolution increase-decrease determination device according to claim 1, wherein the revolution determination unit is configured to determine that the number of engine revolutions is increasing when the phase is increasing at the accelerating rate over time, and to determine that the number of engine revolutions is decreasing when the phase is decreasing at the accelerating rate over time.

3. The revolution increase-decrease determination device according to claim 1, wherein the revolution determination unit is configured to determine that the number of engine revolutions is increasing, by determining that the phase of the frequency signal is increasing at the accelerating rate when the phase curve is convex downward.

4. The revolution increase-decrease determination device according to claim 1, wherein the revolution determination unit is configured to determine that the number of engine revolutions is decreasing, by determining that the phase of the frequency signal is decreasing at the accelerating rate when the phase curve is convex upward.

5. The revolution increase-decrease determination device according to claim 1, wherein the revolution determination unit is configured to determine whether the number of engine revolutions is increasing or decreasing, only when a value representing a temporal fluctuation in the phase of the frequency signal is equal to or smaller than a predetermined threshold.

6. The revolution increase-decrease determination device according to claim 1, wherein the phase curve is expressed by a quadratic polynomial.

7. The revolution increase-decrease determination device according to claim 1, further comprising a phase modification unit configured to modify a phase which is different from a predetermined number of phases, by adding $\pm 2\pi * m$ (radian), where m is a natural number, to the phase so as to reduce a difference between the phase and the predetermined number of phases.

8. The revolution increase-decrease determination device according to claim 1, further comprising:

an error calculation unit configured to calculate an error between the phase curve and the phase of the frequency signal; and a phase modification unit configured to modify the phase of the frequency signal by adding $\pm 2\pi * m$ (radian), where m is a natural number, to the phase so as to include the phase within an angular range, the modification being performed for each of different angular ranges, wherein the phase curve calculation unit is configured to calculate the phase curve for each of the angular ranges, the error calculation unit is configured to calculate the error for each of the angular ranges, the phase modification unit is further configured to select one of the angular ranges in which the error between the phase curve and the phase of the frequency signal is a minimum, and the revolution determination unit is configured to determine whether the number of engine revolutions is increasing or decreasing by determining, on the basis of a form of the phase curve in the selected angular range, whether the phase of the frequency signal is increasing at the accelerating rate or decreasing at the accelerating rate.

9. The revolution increase-decrease determination device according to claim 1, wherein the frequency analysis unit is configured to calculate, from a mixed sound including a noise and an engine sound, a frequency signal at the predetermined frequency for each of the predetermined time periods, the phase curve calculation unit is configured to calculate a phase curve approximating temporal fluctuations in a phase of the frequency signal of the mixed sound, the revolution increase-decrease determination device further comprises:

an error calculation unit configured to calculate an error between the phase curve and the phase of the frequency signal of the mixed sound; and a sound signal identification unit configured to identify, on the basis of the error, whether or not the mixed sound is the engine sound, and the revolution determination unit is configured to determine whether the number of engine revolutions is increasing or decreasing, on the basis of the phase of the mixed sound which is determined as being the engine sound by the sound signal identification unit.

10. The revolution increase-decrease determination device according to claim 1, wherein the frequency analysis unit is configured to calculate a frequency signal for each of a plurality of engine sounds received, respectively, by a plurality of microphones arranged at a distance from each other, and the revolution increase-decrease determination device further comprises a direction detection unit configured to detect a sound source direction of the engine sound on the basis of an arrival time difference between the engine sounds received by the microphones, and to output a result of detecting the sound source direction only when the revolution determination unit determines that the number of engine revolutions is increasing.

11. The revolution increase-decrease determination device according to claim 1, wherein the revolution determination unit is further configured to determine that a vehicle emitting the engine sound is accelerating when the number of engine revolutions is increasing, and to determine that the vehicle emitting the engine sound is decelerating when the number of engine revolutions is decreasing.

12. A revolution increase-decrease determination method comprising:

calculating, from an engine sound, a frequency signal at a predetermined frequency for each of predetermined time periods;

determining whether the number of engine revolutions is increasing or decreasing, by determining whether a phase of the frequency signal is increasing at an accelerating rate over time or decreasing at an accelerating rate over time; and calculating, using a phase curve calculation unit, a phase curve approximating temporal fluctuations in the phase of the frequency signal, wherein, in the determining step, it is determined whether the number of engine revolutions is increasing or decreasing by determining, on the basis of a form of the phase curve, whether the phase of the frequency signal is increasing at the accelerating rate over time or decreasing at the acceleration rate over time.

13. A computer program recorded on a non-transitory computer-readable recording medium for use in a computer, causing, when loaded, the computer to execute:

calculating, from an engine sound, a frequency signal at a predetermined frequency for each of predetermined time periods;

determining whether the number of engine revolutions is increasing or decreasing, by determining whether a phase of the frequency signal is increasing at an accelerating rate over time or decreasing at an accelerating rate over time; and calculating a phase curve approximating temporal fluctuations in the phase of the frequency signal, wherein, in the determining step, it is determined whether the number of engine revolutions is increasing or decreasing by determining, on the basis of a form of the phase curve, whether the phase of the frequency signal is increasing at the accelerating rate over time or decreasing at the acceleration rate over time.

* * * * *